US006457705B2

(12) United States Patent
Nanba et al.

(10) Patent No.: US 6,457,705 B2
(45) Date of Patent: Oct. 1, 2002

(54) SHEET POST PROCESSING DEVICE WITH FEED OUT

(75) Inventors: Toyoaki Nanba, Higashiosaka; Jinichi Nagata, Osaka; Tomomi Tanaka, Yamatokoriyama; Masahiro Kanezaki, Fukuyama; Takehiko Josako, Hiroshima; Hironori Takada, Fukuyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/875,492

(22) Filed: Jun. 6, 2001

Related U.S. Application Data

(62) Division of application No. 09/189,546, filed on Nov. 11, 1998.

(30) Foreign Application Priority Data

Nov. 14, 1997 (JP) ..... 9-314003
Nov. 17, 1997 (JP) ..... 9-315707
Nov. 17, 1997 (JP) ..... 9-315712

(51) Int. Cl.[7] ..... B65H 39/10

(52) U.S. Cl. ..... 270/58.12; 270/58.11; 270/58.16; 270/58.17; 399/407; 399/410

(58) Field of Search ..... 270/58.08, 58.11, 270/58.12, 58.13, 58.14, 58.16, 58.17; 399/407, 408, 410; 227/40

(56) References Cited

U.S. PATENT DOCUMENTS 3,536,318 A * 10/1970 Gay et al. ..... 270/58.11
4,952,989 A 8/1990 Kawano et al.
4,973,036 A 11/1990 Yamashita et al.
4,993,697 A * 2/1991 Yamashita et al. ..... 270/58.17
4,994,865 A * 2/1991 Nishimori et al. ..... 399/410
5,060,921 A * 10/1991 Higashio et al. ..... 270/58.01
5,072,920 A 12/1991 Kubota et al.
5,141,215 A * 8/1992 Ishiguro et al. ..... 270/58.14
5,229,812 A 7/1993 Toyama et al.
5,241,355 A * 8/1993 Yamashita et al. ..... 270/58.07
5,320,336 A 6/1994 Asami
5,382,011 A 1/1995 Tani
5,442,432 A * 8/1995 Tani ..... 399/410
5,481,354 A * 1/1996 Nakajima ..... 399/371
5,622,359 A 4/1997 Kawano et al.
5,765,824 A 6/1998 Kawano et al.
5,852,765 A * 12/1998 Yamashita et al. ..... 270/58.09
5,971,394 A * 10/1999 Kida et al. ..... 270/58.01
6,022,011 A 2/2000 Hirose
6,199,853 B1 * 3/2001 Andoh et al. ..... 270/58.08

FOREIGN PATENT DOCUMENTS

GB 2268481 1/1994

OTHER PUBLICATIONS

European Search Report Dated Feb. 8, 2000 regarding Patent Application No. 98121368.9–2304.
European Search Report Dated Jan. 30, 2001 regarding Patent Application No. 98121368.9.

* cited by examiner

*Primary Examiner*—Christopher P. Ellis
*Assistant Examiner*—Patrick Mackey
(74) *Attorney, Agent, or Firm*—Renner, Otto, Boisselle & Sklar

(57) ABSTRACT

A sheet post-processing device is provided which includes a post-processing tray on which sheets of paper supplied from an image forming device are stacked, and a post-processing section for applying a post-processing operation to edges of one side of the sheets of paper stacked on the post-processing tray. The device further includes a first feed-out opening for discharging, to outside, the sheets of paper having been subject to the post-processing operation, a first discharge transport path for transporting the sheets of paper from the post-processing tray to the first feed-out opening, and a feed-out section for discharging the post-processed sheets of paper from the post-processing tray to the first discharge transport path.

10 Claims, 24 Drawing Sheets

SHEET POST PROCESSING DEVICE WITH FEED OUT

This is a division of copending application Ser. No. 09/189,546, filed Nov. 11, 1998.

FIELD OF THE INVENTION

The present invention relates to a sheet post-processing device which is provided to an image forming device having functions of copying, facsimiling, printing, and the like, and which feeds out sheets of paper supplied from the image forming device after performing a post-processing operation such as a stapling operation with respect to the sheets of paper.

BACKGROUND OF THE INVENTION

A recent copying machine is designed so as to be used in combination with an automatic document transporting device and a sheet post-processing device, for realizing automation of a copying operation, and automation of a stapling operation or a punching operation with respect to sheets of paper having been subject to the copying operation, and the like.

The sheet post-processing device is a device which performs a post-processing operation such as stapling or punching with respect to sheets of paper which are fed out of a copying machine after original images are copied thereon, so that every stack of paper, which is composed of a predetermined number of sheets of paper, is stapled or punched.

For example, one conventional sheet post-processing device is disclosed by the U.S. Patent Publication No. 5072920 (the Japanese Publication for Laid-Open Patent Application No. 3-227694/1991 (Tokukaihei 3-227694)). FIG. 22 is an explanatory view illustrating an arrangement of a sheet post-processing device 100 disclosed by the publication.

In the sheet post-processing device 100, sheets of paper fed out of a copying machine main body are fed in through a feed-in opening 108. Then, in the case where the stapling operation is applied to the sheets, the sheets are guided by a gate 101 to a path 102.

The sheets transported through the path 102 are introduced to a staple tray 103 from its bottom upward, so that the sheets are stacked thereon.

When a predetermined number of the sheets are stacked on the staple tray 103, a stapling operation is applied by a stapler 104 to a lower edge of the sheets thus stacked. The stack of paper thus stapled is moved upward, with its lower edge pushed up by a discharge belt 105, and the stack of paper is brought up till being discharged onto a discharge tray 106. Upon discharge, the stacked sheets are transported with the edges to which the stapling operation is not applied going in front in the transporting direction.

According to the arrangement of the sheet post-processing device 100, however, the sheets to be subject to the stapling operation are fed in through the feed-in opening 108 which is positioned above the staple tray 103. The sheets are transported through the path 102 and introduced onto the staple tray 103 from below, thereby being stacked thereon.

For this reason, the path 102 is curved substantially in a U shape in the vicinity of junction of the path 102 with the staple tray 103, and in the case of the aforementioned arrangement, it is necessary to increase a radius of curvature of the curving part to some extent. This is because jamming of paper tends to occur during transportation in the case where the radius of curvature is set too small. Therefore, the foregoing arrangement has a drawback in that a floor area that the sheet post-processing device 100 occupies becomes large.

Further, as described above, in the sheet post-processing device, the feed-in opening 108 is formed at a position higher than that for the staple tray 103. In such an arrangement as relative position relationship between the staple tray 103 and the feed-in opening 108 is thus specified, a position for the staple tray 103 or the feed-in opening 108 is limited, thereby, for example, causing a space around the staple tray 103 to be narrowed, and limiting freedom in designing the sheet post-processing device. Such limitation is likewise caused in the case where the feed-in opening 108 is formed at a position lower than that for the staple tray 103.

Furthermore, with the foregoing arrangement of the sheet post-processing device 100, upon discharge of the stapled sheets of paper, the stacked sheets are transported with the edges to which the stapling operation is not applied going in front in the transporting direction. Therefore, upon paper discharge, the front edges of the stacked sheets tend to fan out, causing lower sheets to be bent under upper sheets.

Another conventional sheet post-processing device is arranged so that the stapler is moved to a stapling position so as to perform the stapling operation with respect to the stack of paper on the staple tray. With the foregoing arrangement wherein the stapler is moved, however, there arises a drawback in that structure of the sheet post-processing device becomes complicated, or a drawback in that the sheet post-processing device becomes bulkier.

Incidentally, jamming of paper tends to take place during transportation of paper, in the case of a sheet post-processing device which is arranged so that sheets of paper ejected from the copying machine are stacked on a post-processing tray so that the stapling operation as the post-processing operation is applied to the stack of paper thereon, and thereafter the stack of paper is discharged onto a discharge tray. In this case, a jamming sheet is not easily taken out, unless the transport path inside the sheet post-processing device is openable.

Such a structure which facilitates taking out of a jamming sheet is hereinafter referred to as a paper jam solving structure. A copying machine with such a paper jam solving structure is disclosed by, for example, the U.S. Patent Publication No.4952989 (the Japanese Publication for Laid-Open Patent Application No. 61-239256/1986 (Tokukaisho 61-239256)).

FIG. 23 is an explanatory view illustrating a sheet transport path in the copying machine disclosed by the foregoing publication. As shown in FIG. 23, in this copying machine, a sheet (paper) is fed from feed cassettes 201 through feed rollers 202, 203, and 204 to a position below a photoreceptor 205. Subsequently, an image on the photoreceptor 205 is transferred to the sheet, and thereafter the sheet is transported to a fixing device (not shown) by a conveyer belt 206 provided with air suction means. After a fixing operation, the sheet is fed out.

Here, in the copying machine, the conveyer belt 206 is substantially horizontally disposed. Besides, the conveyer belt 206 is movably provided so as to incline downward by pivoting around a shaft 206a provided on a downstream side of a transport direction. Furthermore, a supporting member 207 of the feed rollers 203 is provided vertically, and rotatably with respect to a shaft 207*a* provided in a bottom part of the supporting member 207.

Furthermore, the conveyer belt 206 is supported by a supporting arm 209. The supporting arm 209 has a roller 208 at its top end, and is supported by a shaft 209*a* provided at a bottom end thereof so that the supporting arm 209 is rotatable with respect to the shaft 209*a*.

The supporting member 207 is supported by a connecting piece 210, with one side of the supporting member 207 being pinned to one end of the connecting piece 210. The other end of the connecting piece 210 is rotatably connected to a middle part of the supporting arm 209.

In the case of the foregoing arrangement, if jamming of paper takes place, the supporting arm 209 is rotated around the shaft 209*a* as axis in an anti-clockwise direction, as shown in FIG. 24. With the rotation, the conveyer belt 206 rotates around the shaft 206*a* as axis in a clockwise direction. As a result, a transport path between the photoreceptor 205 and the conveyer belt 206 is opened.

Besides, the anti-clockwise rotation (laying down) of the supporting arm 209 causes the connecting piece 210 to pull the supporting member 207. As a result, a transport path facing the feed rollers 203 is opened.

Thus, the copying machine is arranged so that only by laying down the supporting arm 209, the transport paths on the feed-in and feed-out sides with respect to the photoreceptor 205 are opened, whereby jamming of paper is easily solved.

In the paper jam solving structure of the foregoing copying machine, however, the supporting arm 209 for supporting the conveyer belt 206 is rotatably provided so that the transport path is openable. Therefore, a sufficient space is required to allow the supporting arm 209 to rotate. In other words, the aforementioned paper jam solving structure has the following drawback in that ensuring that the transport path can be sufficiently opened makes it difficult to form the copying machine thinner.

SUMMARY OF THE INVENTION

The first object of the present invention is to provide a sheet post-processing device arranged so that limitation on positions of a post-processing tray (stapling tray) and a feed-in opening of the sheet post-processing device is small.

The second object of the present invention is to provide a sheet post-processing device which is capable of stably discharging sheets of paper while which is neither complicated nor bulky.

To achieve the aforementioned first object, the sheet post-processing device of the present invention comprises (1) a feed-in opening through which sheets of paper fed out of an image forming device are supplied, (2) a post-processing tray on which the sheets of paper are stacked, and (3) a post-processing section for applying a post-processing operation to the sheets of paper stacked on the post-processing tray, and is characterized in that the feed-in opening is positioned not higher than a position of an upper edge of the post-processing tray and not lower than a position of a lower edge of the post-processing tray.

With the foregoing arrangement, a part of the post-processing tray is positioned higher than the position of the feed-in opening. Consequently, the limitation on the positions of the post-processing tray and the feed-in opening in the sheet post-processing device can be made smaller.

Furthermore, with the foregoing arrangement, the post-processing tray can be disposed in an upper part of the sheet post-processing device. Therefore, it is possible to ensure a sufficient discharge capacity even in the case where the post-processed sheets of paper are fed out through the lower edge of the post-processing tray onto the discharge tray, without bringing them up.

Furthermore, to achieve the second object, the sheet post-processing device of the present invention comprises (1) a post-processing tray, (2) a post-processing section for applying a post-processing operation to edges of one side of the sheets of paper stacked on the post-processing tray, (3) a first feed-out opening for discharging, to outside, the sheets of paper having been subject to the post-processing operation, (4) a first discharge transport path for transporting the sheets of paper from the post-processing tray to the first feed-out opening, and (5) a feed-out section for discharging the post-processed sheets of paper from the post-processing tray to the first discharge transport path, and is characterized in that the post-processing tray has an adjusting-moving section for adjusting the stacked sheet of paper, moving the adjusted sheets of paper to a post-processing position at which a post-processing operation by the post-processing section can be applied, and moving the post-processed sheets of paper to a discharge position at which a discharging operation by the feed-out section is applied.

With the foregoing arrangement, the sheets of paper stacked on the post-processing tray are moved to the post-processing position by the adjusting-moving section. The post-processing position is a position at which a post-processing operation can be applied to the sheets of paper by the post-processing section. Then, the sheets of paper thus post-processed are moved to the discharge position by the adjusting-moving section. The discharge position is a position at which the discharging operation can be applied to the sheets of paper by the feed-out section.

Thus, according to the foregoing arrangement, upon application of the post-processing operation to the sheets of paper stacked on the post-processing tray, not the post-processing section but the sheets of paper are moved. Therefore, with the foregoing arrangement, there is no need to provide a driving system for moving the post-processing section, and therefore, it is possible to make the sheet post-processing device simpler and smaller.

For a fuller understanding of the nature and advantages of the invention, reference should be made to the ensuing detailed description taken in conjunction with the accompanying drawings.

BRIEF DESCRIPTION OF THE DRAWINGS

FIG. 5(*b*) is an explanatory view showing a switched state of the feed-in gate, the reversing gate, and the switching gate of the sheet post-processing device shown in FIG. 1 in the case where the sheets of paper supplied from a copying machine are sent to a reversing path.

FIG. 5(*c*) is an explanatory view showing a switched state of the feed-in gate, the reversing gate, and the switching gate of the sheet post-processing device shown in FIG. 1 in the case where the sheets of paper sent to the reversing path is switched back, and thereafter sent to a detour path via a connecting path.

FIG. 5(*d*) is an explanatory view showing a switched state of the feed-in gate, the reversing gate, and the switching gate of the sheet post-processing device shown in FIG. 1 in the case where the sheets of paper supplied from the copying machine are directly sent to the detour path.

FIG. 6(*b*) is an explanatory view illustrating the stapling operation in the sheet post-processing device shown in FIG. 1, particularly showing a state in which a sheet supporter is brought down and a stapling operation is applied to the stack of paper.

FIG. 6(*c*) is an explanatory view illustrating the stapling operation in the sheet post-processing device shown in FIG. 1, particularly showing a state in which a sheet supporter is brought down and a stapling operation is applied to the stack of paper.

FIG. 6(*d*) is an explanatory view illustrating the stapling operation in the sheet post-processing device shown in FIG. 1, particularly showing a state in which the stapled stack of paper is discharged onto an offset tray.

FIG. 7(*b*) is an explanatory view illustrating a switched state of the feed-in gate, the reversing gate, and the switching gate in the case where three associated rollers are used as the reversing rollers in the sheet post-processing device shown in FIG. 1, particularly showing a state in which the sheets of paper supplied from the copying machine are sent to the reversing path.

FIG. 7(*c*) is an explanatory view illustrating a switched state of the feed-in gate, the reversing gate, and the switching gate in the case where three associated rollers are used as the reversing rollers in the sheet post-processing device shown in FIG. 1, particularly showing a state in which the sheets of paper sent to the reversing path are switched back and sent to the detour path via the connecting path.

FIG. 7(*d*) is an explanatory view illustrating a switched state of the feed-in gate, the reversing gate, and the switching gate in the case where three associated rollers are used as the reversing rollers in the sheet post-processing device shown in FIG. 1, particularly showing a state in which the sheets of paper supplied from the copying machine are directly sent to the detour path.

FIG. 8(*b*) is an explanatory view illustrating a state of sheet transportation in which the sheets of paper supplied from the copying machine are sent to the reversing path, or a state of sheet transportation in which the sheets of paper sent to the reversing path are once switched back and thereafter sent to the detour path via the connecting path, in the case where the reversing path and the lower staple tray of the sheet post-processing device shown in FIG. 1 are arranged so as to be pivotable.

FIG. 17(*b*) is an explanatory view illustrating a state of the stapling operation by the stapling system shown in FIG. 15, in which a stack of paper composed of a predetermined number of sheets of paper is formed on the lower staple tray.

FIG. 17(*c*) is an explanatory view illustrating a state of the stapling operation by the stapling system shown in FIG. 15, in which the stack of paper is inserted to the stapler.

FIG. 18(*b*) is an explanatory view illustrating a state of the stapling operation by the stapling system shown in FIG. 15, in which the stack of paper stapled is separated from the stapler.

FIG. 18(*c*) is an explanatory view illustrating a state of the stapling operation by the stapling system shown in FIG. 15, in which the switching gate is turned so that the stack of paper stapled and separated from the stapler is discharged on the offset tray.

FIG. 19(*b*) is an explanatory view illustrating a state of the stapling operation by the stapling system shown in FIG. 15, in which the stack of paper on the switching gate is pressed by the transport rollers.

FIG. 19(*c*) is an explanatory view illustrating a state of the stapling operation by the stapling system shown in FIG. 15, in which the stack of paper on the switching gate is sent by the transport rollers to the offset tray discharge path.

DESCRIPTION OF THE PREFERRED EMBODIMENTS

[First Embodiment]

The following description will explain a first embodiment of the present invention.

Figure 1:
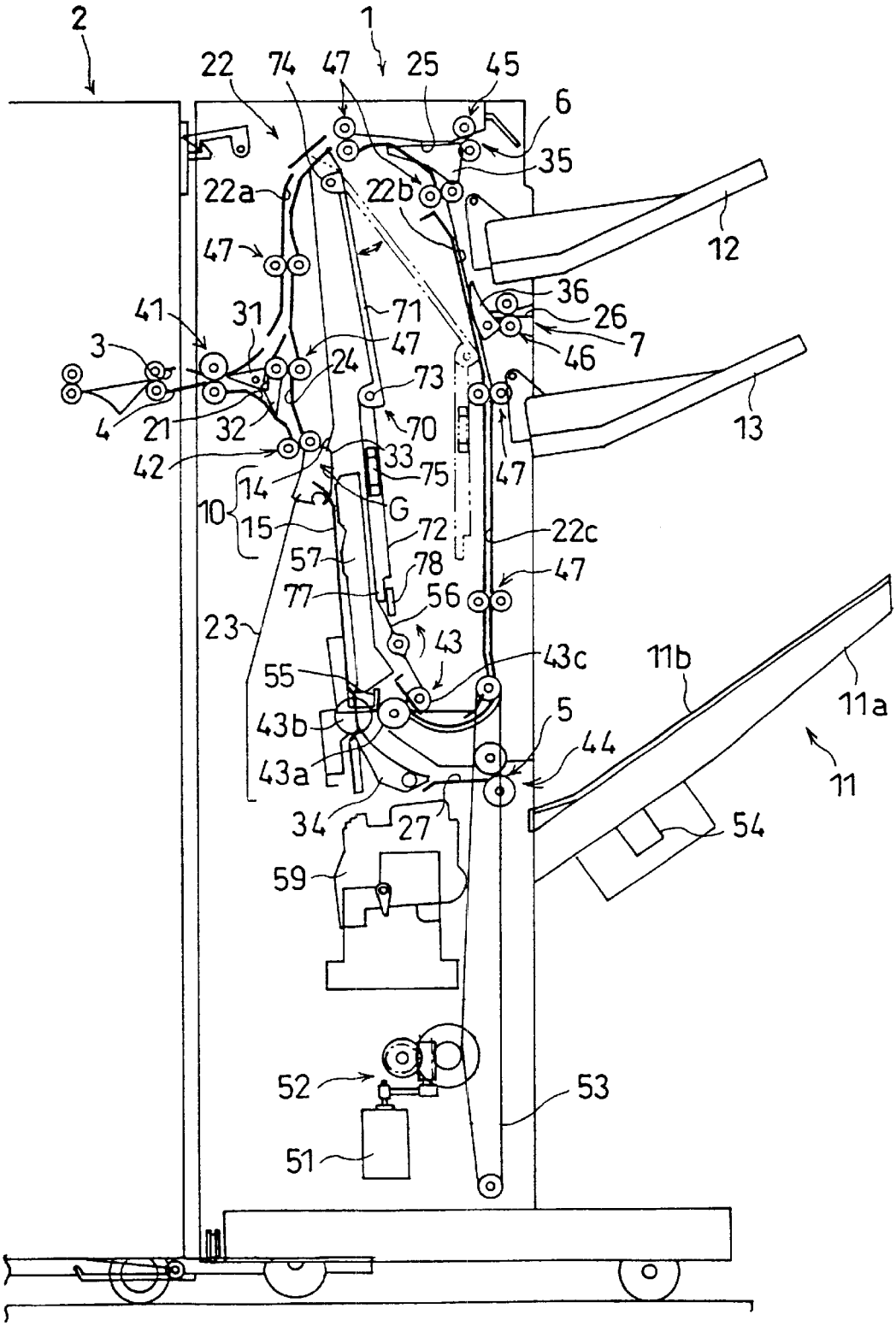
FIG. 1 is an explanatory view illustrating a schematic arrangement of a sheet post-processing device in accordance with first through third embodiments of the present invention.

FIG. 1 is an explanatory view illustrating an arrangement of a sheet post-processing device 1 as a sheet post-processing device in accordance with the present embodiment. As shown by the figure, the sheet post-processing device 1 is disposed on a side of a feed-out opening 3 of a copying machine 2.

The copying machine 2 is an image forming device such as a usual copying machine, for example, a digital copying machine or a digital color copying machine. The sheet post-processing device 1 is supplied with sheets of paper, OHP sheets, and the like, fed out of the copying machine 2, so as to perform a post-processing operation such as stapling, a sheet sorting operation, and the like with respect to the sheets thus supplied thereto.

The following description will explain an arrangement of the sheet post-processing device 1.

The sheet post-processing device 1 has a feed-in opening 4 through which sheets of paper fed out of the copying machine 2 are supplied. The feed-in opening 4 is at a position not lower than the lower edge of a staple tray 10 which will be described later, and not higher than the upper edge of the staple tray 10.

The sheet post-processing device 1 is arranged so as to be separable from the copying machine 2 in a sheet discharge direction (rightward as viewed in FIG. 1). Therefore, it is possible to disposing of jamming sheets or to exchange staple needles in a state in which the sheet post-processing device 1 is separated from the copying machine 2.

When the sheet post-processing device 1 is connected to the copying machine 2, an inclining rail attached on the side of the sheet post-processing device 1 is placed on a guide member on the side of the copying machine 2. Consequently, a height of the feed-out opening 3 of the copying machine 2 coincides to a height of the feed-in opening 4 of the sheet post-processing device 1 with high precision.

In the sheet post-processing device 1, a plurality of sheets of paper which are stapled are fed out of a feed-out opening (first feed-out opening) 5. To store the sheets of paper discharged from the feed-out opening 5, an offset tray (first discharge tray) 11 is provided.

The offset tray 11 is a discharge tray which is movable upward/downward driven by a elevation motor 51, and capable of an offset sorting operation. A driving force of the elevation motor 51 is transmitted to the offset tray 11 through a driving force transmitting system 52 composed of gears and the like, then, through a driving wire 53.

The offset tray 11 has a double structure, composed of a lower offset tray reinforcing plate 11*a* and an upper offset tray plate 11*b*. The offset tray plate 11*b* is movably provided so as to, with a driving force of an offset motor 54, shift in parallel with the offset tray reinforcing plate 11*a*. Note that the direction of the movement of the offset tray plate 11*b* is perpendicular to a sheet transport direction.

Furthermore, to discharge a plurality of sheets of paper or stacks of sheets of paper and to apply the offset sorting operation with respect to the sheets or stacks, the offset tray plate 11*b* is shifted rightward and leftward alternately, every time one sheet or one stack is fed out. By so doing, the sheets or the stacks are stored on the offset tray 11 in a state in which they are offsetted rightward and leftward alternately. Therefore, even in the case where the stapling operation is not applied, the stack sorting operation becomes very easy.

Furthermore, the sheet post-processing device 1 has feed-out openings (second feed-out openings) 6 and 7 as openings through which sheets of paper are fed out, in addition to the feed-out opening 5. As discharge trays other than the offset tray 11, two fixed trays (second discharge trays), namely, an upper fixed tray 12 and a lower fixed tray 13, are provided, corresponding to the feed-out openings 6 and 7, respectively.

Therefore, in the case where the copying machine 2 operates in three-type operational modes, namely, a copy mode, a facsimile mode, and a print mode, the trays 11 through 13 can be used depending on the operational mode.

Incidentally, in the case where the stapling operation is not applied to sheets of paper, the sheet post-processing device 1 is arranged so that the offset tray 11, the upper fixed tray 12, and the lower fixed tray 13 are used in the copy mode, in the facsimile mode, and in the print mode, respectively, as the discharge tray. In the case where the stapling operation is applied to sheets, the sheet post-processing device 1 is arranged so that, irrelevant to the operational modes of the copying machine 2, stacks of sheets of paper are discharged onto the offset tray 11.

The sheet post-processing device 1 further includes, in the vicinity of an upper part thereof, a staple tray 10 for stacking sheets to which the stapling operation is to be applied.

The staple tray 10 is arranged so that sheets are stacked on a surface opposite to the feed-in opening 4 side (a sheet-carrying surface). The staple tray 10, separated into an upper staple tray 14 and a lower staple tray 15, is substantially vertically disposed. Through a gap (sheet passing opening, aperture) G between the trays 14 and 15, sheets of paper are transported from a direct path 21 (described later) to the lower staple tray 15.

The staple trays 14 and 15 are trays for temporarily storing stacks of paper to which the stapling operation is to be applied, and are formed perpendicularly (vertically), with the gap G therebetween. The lower staple tray 15 also serves as a path which forms a part of a sheet transport path in the sheet post-processing device 1.

Besides, the staple tray 10 is equipped with a sheet supporter 55, a paddler 56, and adjusting plates 57, as shown in FIG. 1.

The sheet supporter (sheet supporting member) 55 is a member with which lower edges of a plurality of sheets of paper stacked are in contact so as to be adjusted, and is movably provided so as to shift upward/downward along the lower staple tray 15. The sheet supporter 55 shifts upward/downward in a state of carrying the sheets of paper, so that the stack of paper is moved to a stacking position, a stapling position (post-processing position), or a recessional position, and a discharge position which are predetermined.

More specifically, the sheet supporter 55 places sheets of paper at the stacking position when the sheets are being stacked on the staple tray 10. Then, when a predetermined number of sheets are stacked on the staple tray 10, the sheet supporter 55 is shifted downward so that the stack of sheets of paper is moved to the stapling position.

After the stapling operation is applied to the stack of paper, the sheet supporter 55 is shifted upward so that the stack of paper is moved to the recessional position. To discharge the stack of paper onto the offset tray 11, the sheet supporter 55 descends so as to bring down the stack of paper to the predetermined discharge position. Note that upon discharge, the stack of paper is transported to the offset tray 11 through an offset tray discharge path 27 which will be described later.

The adjusting plates (sheet adjusting member) 57 supports the stack of paper placed on the sheet supporter 55 from both sides of the stack, so that side edges of the stacked sheets of paper are adjusted.

Further, the paddler 56 is for ensuring that the sheets of paper are carried on the sheet supporter 55. The paddler 56 is arranged so as to rotate in the anti-clockwise direction as viewed in FIG. 1 every time one sheet is supplied to the lower staple tray 15. Since the rotation of the paddler 56 gives a downward transporting force to the sheets, the sheets are surely adjusted on the sheet supporter 55. As a result, it is possible to prevent the sheets from becoming untidy on the sheet supporter 55 due to static electricity or the like.

Furthermore, the sheet post-processing device 1 incorporates a stapler (post-processing section) 59. The stapler 59 is for applying a stapling operation with respect to sheets of paper, and is disposed below the staple tray 10. The stapler 59 applies the stapling operation with respect to the stack of paper when the stack descends to the stapling position.

Moreover, the sheet post-processing device 1 incorporates a paper guide 70 for catching the sheets of paper stacked on the staple tray 10. The paper guide 70 is for catching at least upper edges of the sheets, and is composed of two plates, namely, an upper plate 71 and a lower plate 72. Incidentally, it is possible to manually move the paper guide 70 to a predetermined recessional position, upon a paper jam solving operation.

As described above, the staple tray 10 is disposed substantially perpendicularly, and further, in the upper staple tray 14 region, the stack of paper is supported only from one side. Therefore, the stacked sheets of paper may fall down to an opposite side to the staple tray 10 (right-hand side as viewed in FIG. 1). To avoid this, in the sheet post-processing device 1, the sheets of paper are held so that the staple tray 10 and the paper guide 70 catch the sheets therebetween, to prevent such falling of the sheets.

The sheet post-processing device 1 includes a plurality of paths (sheet passing path, transport path) corresponding to combinations of types of paper and processing operations conducted with respect to the sheets of paper. Such paths correspond to sizes of paper to be discharged, application and non-application of the stapling operation, necessity or non-necessity of reversing feeding, types of the discharge trays, etc. In the sheet post-processing device 1, desired paths are selected from among the plurality of the paths and are combined so as to form one transport route. The transport route refers to a route through which sheets of paper supplied from the copying machine 2 are subject to desired operations and thereafter discharged.

Figure 2:
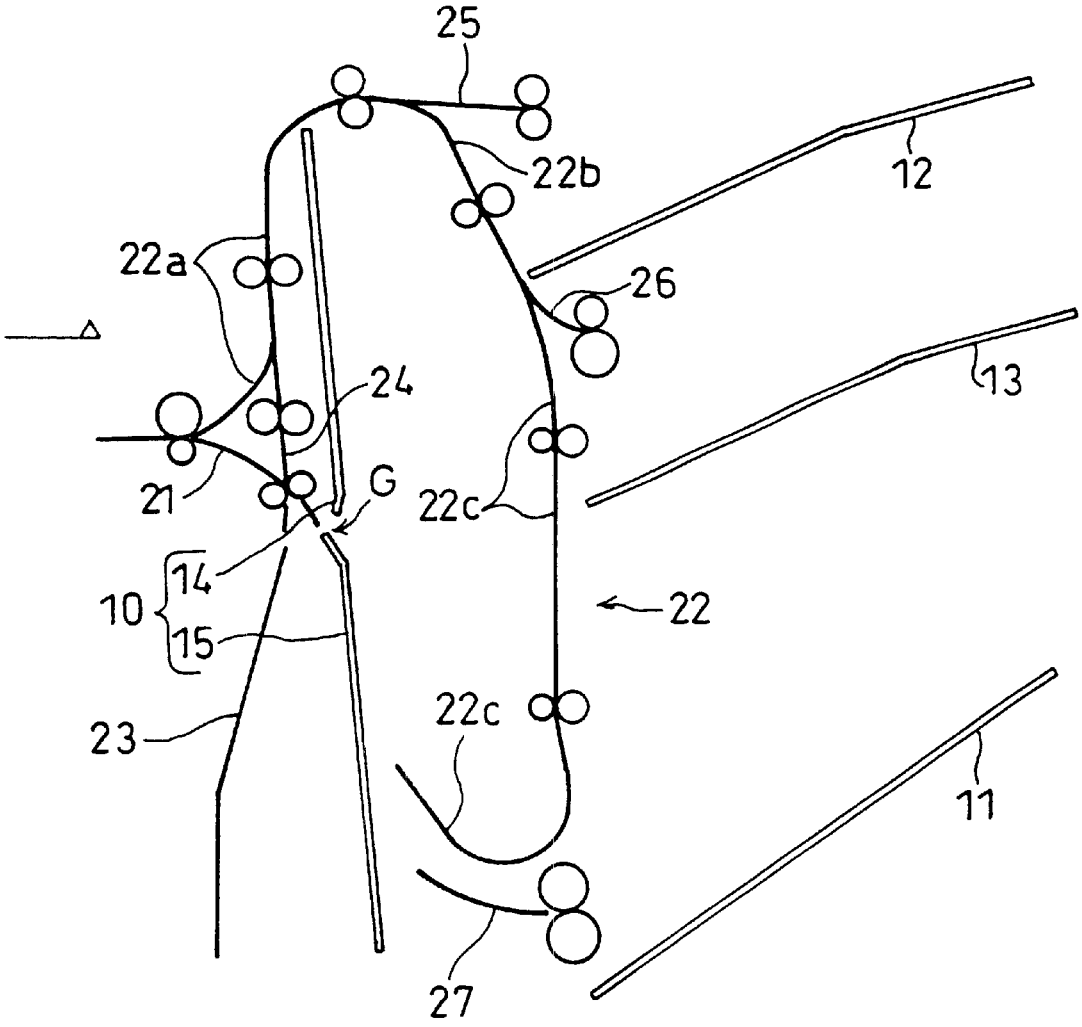
FIG. 2 is an explanatory view illustrating paths of the sheet post-processing device shown in FIG. 1.

FIG. 2 is an explanatory view illustrating paths in the sheet post-processing device 1. As shown in the figure, concretely, the paths are a direct path 21, a detour path 22, a reversing path 23, a connecting path 24, an upper fixed tray discharge path 25, a lower fixed tray discharge path 26, an offset tray discharge path 27, and a lower staple tray 15.

The direct path (direct transport path) 21 extends from the feed-in opening 4 downward. It goes through reversing rollers 42 and reaches the gap G between the upper staple tray 14 and the lower staple tray 15. As described above, the gap G is a sheet passing opening through which sheets of paper are supplied to the lower staple tray 15.

The detour path (detour transport path) 22 extends from the feed-in opening 4 upward (detour path part 22*a*), and curves so as to go around the upper edge of the staple tray 14. After curving, it extends downward along a side wall of the sheet post-processing device 1 on a side to the trays (detour path parts 22*b*, 22*c*), and again curves before an upper portion of the offset tray 11 so as to connect to the lower edge of the lower staple tray 15.

Thus, the whole detour path 22 from the feed-in opening 4 to the lower edge of the lower staple tray 15 is divided into the three parts, that is, the detour path parts 22*a* through 22*c*. From a junction point of the detour path parts 22*a* and 22*b*, the upper fixed tray discharge path 25 branches out. From a junction point of the detour path parts 22*b* and 22*c*, the lower fixed tray discharge path 26 branches out.

The upper fixed tray discharge path (second discharge transport path) 25 is a path through which sheets of paper are discharged onto the upper fixed tray 12. The lower fixed tray discharge path (second discharge transport path) 26 is a path through which sheets of paper are discharged onto the lower fixed tray 13.

The reversing path (reversing transport path) 23 extends substantially perpendicularly from a point at which the direct path 21 crosses the upper and lower staple trays 14 and 15 with the gap G therebetween, in the vicinity of the reversing rollers 42, on a side to the copying machine 2.

The reversing path 23 and the connecting path 24 are used in the case where sheets of paper are sent to the detour path 22 by switchback. More specifically, in this case, sheets of paper transported through the direct path 21 are not sent to the lower staple tray 15 but are transported to the reversing path 23. The sheets introduced to the reversing path 23 are thereafter sent to the connecting path 24 by rotation of the reversing rollers 42 in the opposite directions, and then, sent to the detour path 22.

The offset tray discharge path (first discharge transport path) 27 is substantially horizontally provided so as to go from the lower edge of the lower staple tray 15 to below the detour path 22. Besides, sheets of paper sent from the lower edge of the lower staple tray 15 are sent through the offset tray discharge path 27 so as to be discharged onto the offset tray 11.

Desired paths are selected from among the aforementioned paths, depending on the operational mode of the copying machine 2, the size of the sheets transported, and the like, and the transport paths are switched in accordance with the foregoing selection. The switch of the transport paths is realized by controlling (switching) positions of gates respectively provided at junction points of the paths and rotational directions of transport rollers. Further, transport of paper along the paths is also carried out by the transport rollers.

Figure 3:
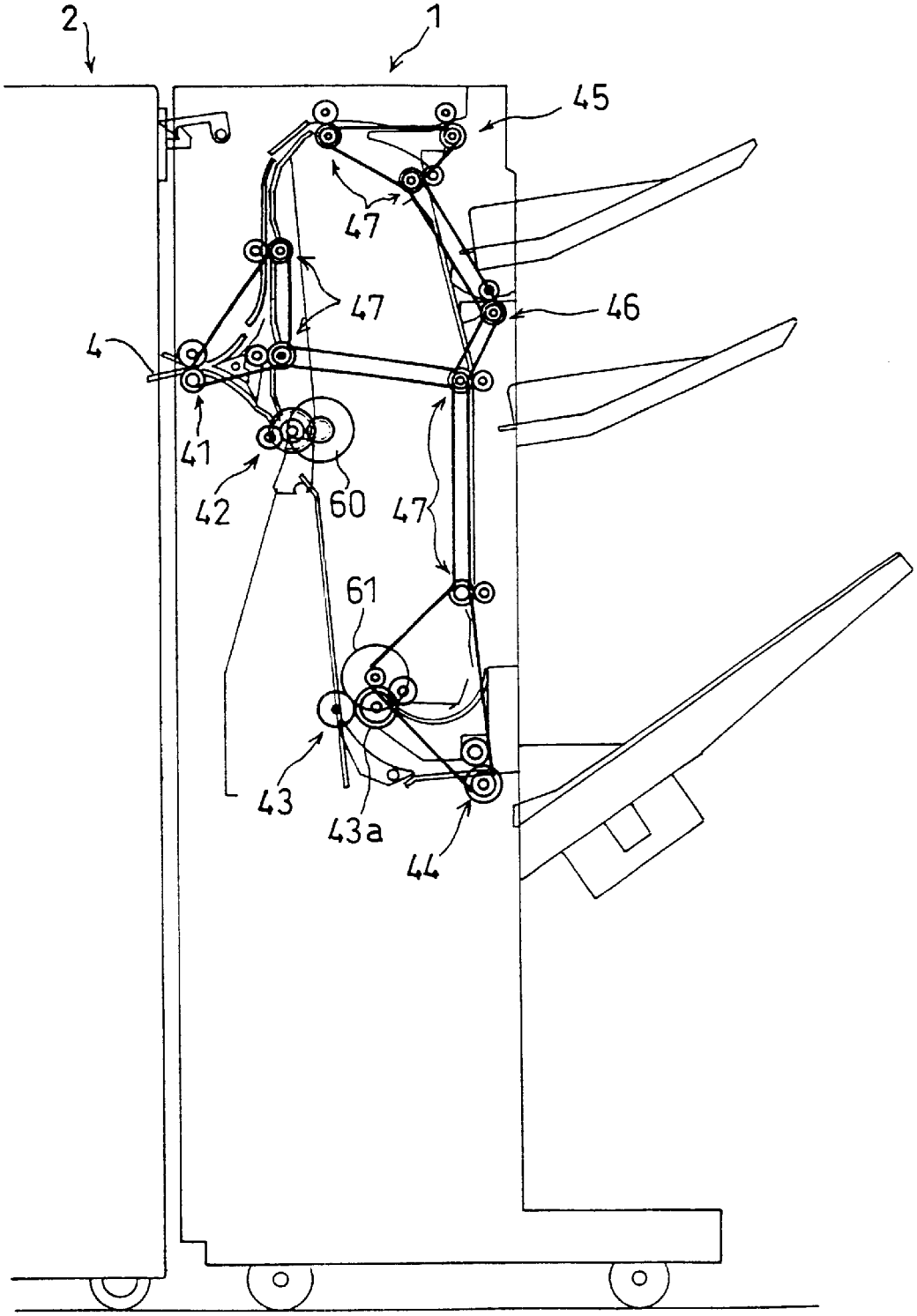
FIG. 3 is an explanatory view illustrating driving systems of transport rollers of the sheet post-processing device shown in FIG. 1.

FIG. 3 is an explanatory view illustrating the transport rollers provided in the sheet post-processing device 1. As shown in this figure, feed-in rollers 41, the reversing rollers 42, transport rollers 43, feed-out rollers 44 through 46, and a plurality of transport rollers 47 are provided in the sheet post-processing device 1.

The feed-in rollers 41 are positioned in the vicinity of the feed-in opening 4 of the sheet post-processing device 1. The feed-in rollers 41 are for transporting sheets supplied to the feed-in opening 4 to the direct path 21.

The reversing rollers (a fed-in sheet transport destination switching section, first switching rollers) 42 are disposed at ends of the direct path 21 and the reversing path 23. The reversing rollers 42 are arranged so that their rotational directions are freely switched.

Non-reverse rotation of the reversing rollers 42 causes the sheets of paper from the direct path 21 to be sent to either the lower staple tray 15 or the reversing path 23. On the other hand, reverse rotation of the reversing rollers 42 causes the sheets from the reversing path 23 to be sent to the detour path 22 via the connecting path 24.

The transport rollers (discharge section, discharge rollers) 43 are disposed at the lower edge of the staple tray 10, as shown in FIG. 1. The transport rollers 43 are constituted by a driving roller 43*a* to which a driving force of a motor is transmitted, and two driven rollers 43*b* and 43*c* which rotate by contacting the driving roller 43*a*.

The driving roller 43*a* and the driven roller 43*b* have a function of sending the stack of paper from the staple tray 10 to the offset tray discharge path 27. More specifically, in a transporting operation, the rollers 43*a* and 43*b* rotate while pressing the stack of paper P. The driving roller 43*a* and the driven roller 43*c* has a function of sending sheets of paper supplied from the detour path 22 into the staple tray 10.

The driven roller 43*b* is formed so as to be in contact with, but separable from, the driving roller 43*a*. When the stack of paper is moved to the stapler 59, the driven roller 43*b* is moved to a predetermined recessional position so as not to obstacle the movement of the stack of paper.

The feed-out rollers 44 through 46 are transport rollers provided at ends of the offset tray discharge path 27, the upper fixed tray discharge path 25, and the lower fixed tray discharge path 26, respectively. The feed-out rollers 44 through 46 discharge sheets of paper on the paths to the trays 11 through 13, respectively.

The transport rollers 47 are provided for giving a transporting force to the sheets in the detour path 22 and the connecting path 24. They are appropriately provided at predetermined intervals.

Note that the transport rollers other than the transport rollers 43 are also composed of driving rollers to which a driving force of a motor is transmitted and driven rollers which rotate by contacting the driving rollers.

Among the transport rollers, the reversing rollers 42 rotate in two directions, a non-reverse rotational direction and a reverse rotational direction, while the other transport rollers rotate in one direction. Therefore, it is preferable that a motor for driving the reversing rollers 42 and a motor for driving the other rollers are separately provided.

Figure 4:
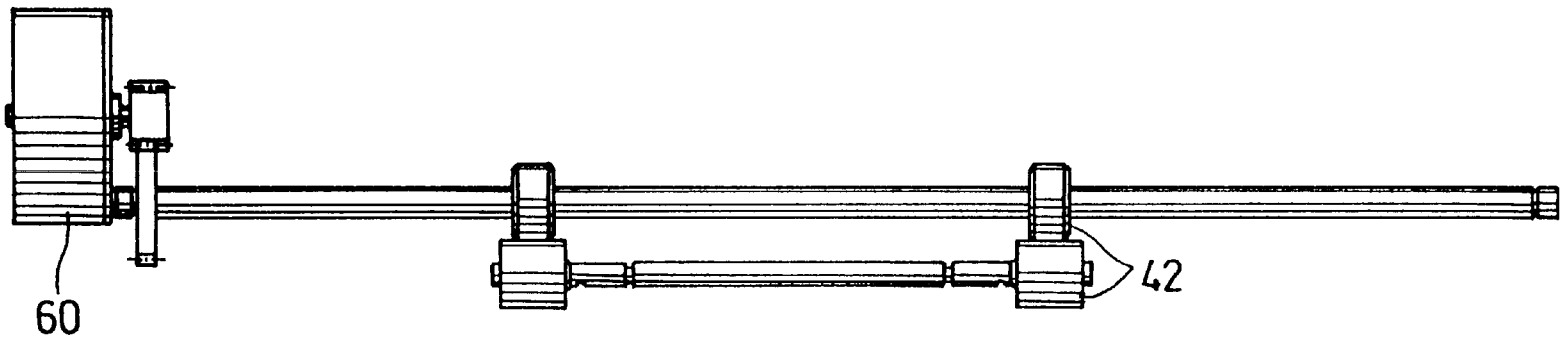
FIG. 4 is a plan view illustrating the driving system of reversing rollers of the sheet post-processing device shown in FIG. 1.
Figure 5A:
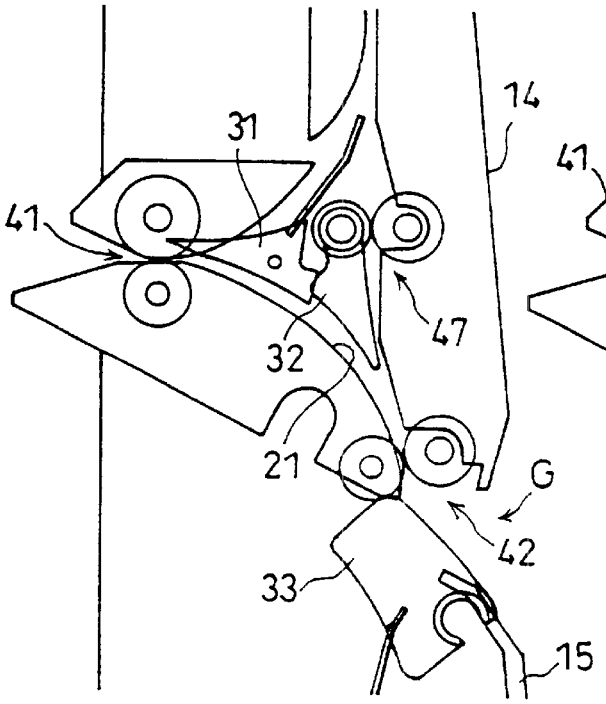
FIG. 5(*a*) is an explanatory view showing a switched state of a feed-in gate, a reversing gate, and a switching gate of the sheet post-processing device shown in FIG. 1 in the case where the stapling operation is applied to the sheets of paper smaller than the letter size.
Figure 5B:
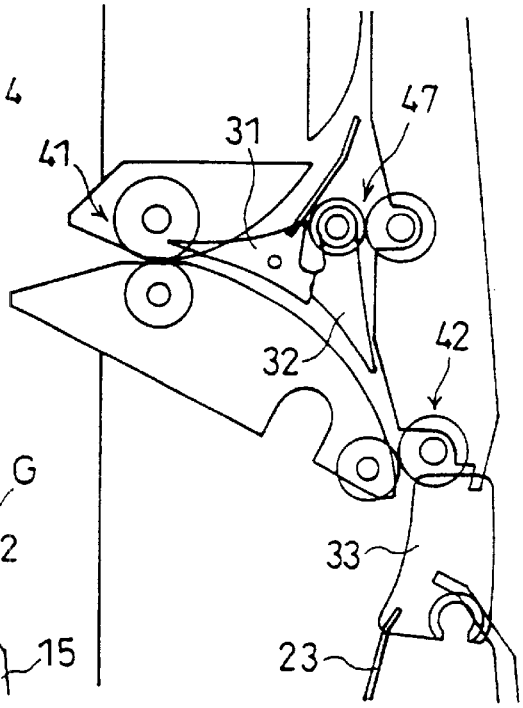
Figure 5C:
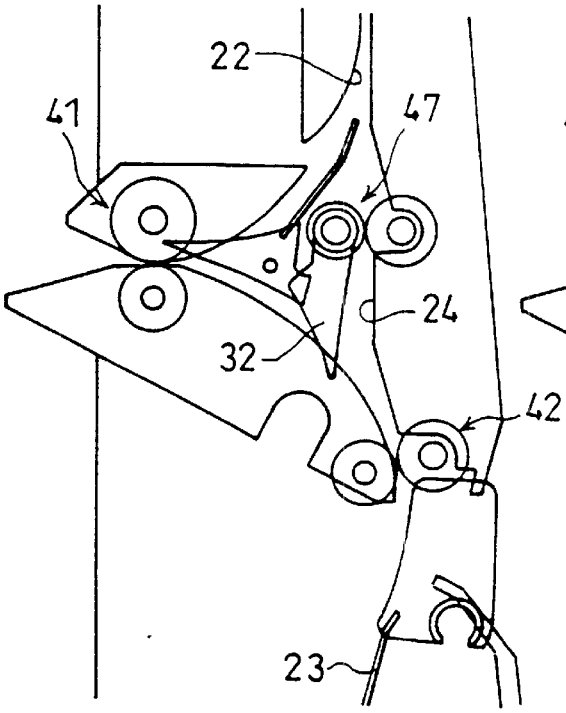
Figure 5D:
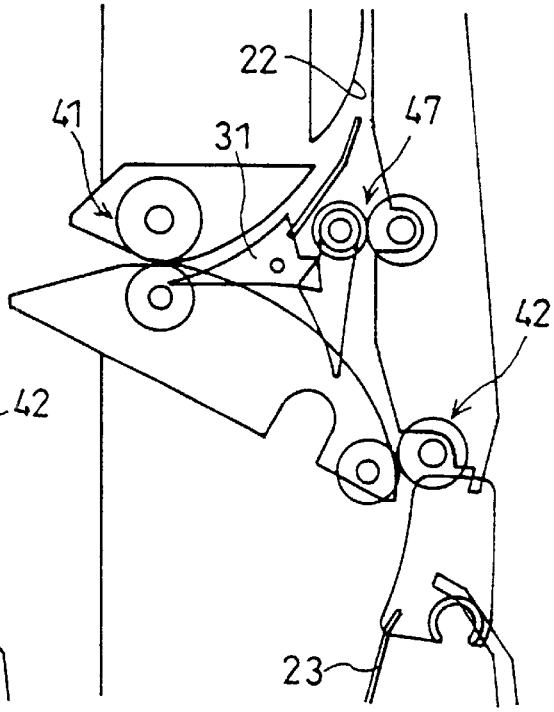

Therefore, as shown in FIG. 3, the sheet post-processing device 1 has two motors, i.e., a reversing motor 60 and a transport motor 61. The reversing motor (second driving system) 60 is a motor for driving the reversing rollers 42 as shown in FIGS. 3 or 4, that is, for causing the reversing rollers 42 to rotate in the non-reverse direction and the reverse direction.

The transport motor (first driving system) 61 is a motor for driving the transport rollers other than the reversing rollers 42, causing the transport rollers in one predetermined direction. Besides, the transport motor 61 directly drives the driving roller 43*a* of the transport rollers 43, while the driving force is transmitted to the other transport rollers through a belt and pulleys.

As shown in FIG. 1, the sheet post-processing device 1 is equipped with a feed-in gate 31, a reversing gate 32, a switching gate 33, a switching gate 34, feed-out gates 35 and 36, and a switching gate 37, as gates for switching the transport paths.

FIGS. 5(*a*) through 5(*d*) are explanatory views illustrating arrangements and switching operations of the gates 31 through 33. As made clear by the figures, the feed-in gate 31 is a gate just on a downstream side to the feed-in rollers 41. The feed-in gate 31 is provided of switching the path for sheets of paper fed by the feed-in rollers 41, between the direct path 21 and the detour path 22.

The reversing gate 32 is a gate provided on an upstream side to the reversing rollers 42. When the reversing rollers 42 rotate in the non-reverse direction, the reversing gate 32 opens the direct path 21 while closes the connecting path 24. On the other hand, when the reversing rollers 42 rotates in the reverse direction, the reversing gate 32 closes the direct path 21 while opens the connecting path 24.

The switching gate (fed-in sheet transport destination switching section, first switching gate) 33 is a gate provided just on a downstream side to the reversing rollers 42. The switching gate 33 is provided for switching the path for transport of sheets of paper during non-reverse rotation of the reversing rollers 42, between the lower staple tray 15 and the reversing path 23.

The switching gate (discharge section, third switching gate) 34 is provided on a downstream side to the lower staple tray 15. The switching gate 34 is provided for switching the path of sheets of paper stacked on the lower staple tray 15, between the offset tray 11 and the offset tray discharge path 27.

The feed-out gate 35 is a gate provided in the detour path 22. The feed-out gate 35 is provided for switching the transport path for sheets of paper supplied thereto through the detour path 22, depending on whether or not the sheets of paper are to be discharged to the upper fixed tray 12. The feed-out gate 36 is provided on a downstream side to the feed-out gate 35. The feed-out gate 36 is provided for switching the transport path for sheets of paper supplied thereto through the feed-out gate 35, depending on whether or not the sheets of paper are to be discharged to the lower fixed tray 13.

The following description will explain an operation of the sheet post-processing device 1 in accordance with the operational modes of the copying machine 2.

(Copy-mode Operations)

To start with, the following description will explain a case where a stack of paper composed of a predetermined number of sheets of paper is formed when the copying machine 2 is in the copy mode and the stack of paper is fed out after being stapled.

When a stapling operation is applied, in the sheet post-processing device 1, the operation applied to the sheets and the transporting path selected are different depending on whether or not the size of the paper is greater than the letter size (A4 size, width:length=210 mm:297 mm).

First of all, the operation and the transport path of the sheet post-processing device 1 in the case where the paper size is equal to or smaller than the letter size will be explained. The transport path in this case takes the following route in FIG. 2: the direct path 21—the staple tray 10 (only the lower staple tray 15)—the offset tray discharge path 27—the offset tray 11. In this case, the feed-in gate 31, the reversing gate 32, and the switching gate 33 are turned as shown in FIG. 5(*a*).

Figures 6A, 6B, 6C, 6D:
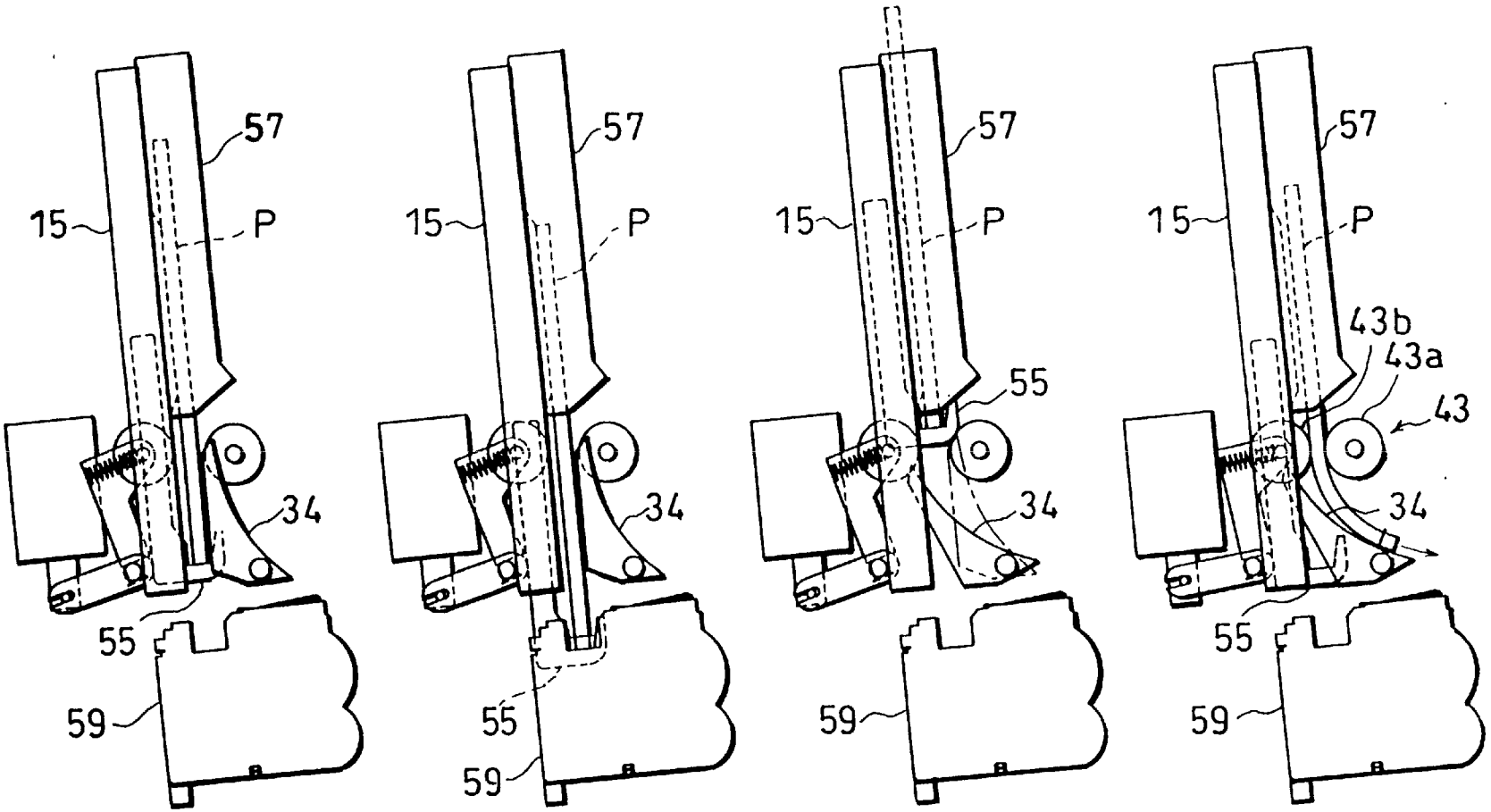
FIG. 6(*a*) is an explanatory view illustrating the stapling operation in the sheet post-processing device shown in FIG. 1, particularly showing a state in which sheets of paper are stacked on a lower staple tray.
Figure 7A:
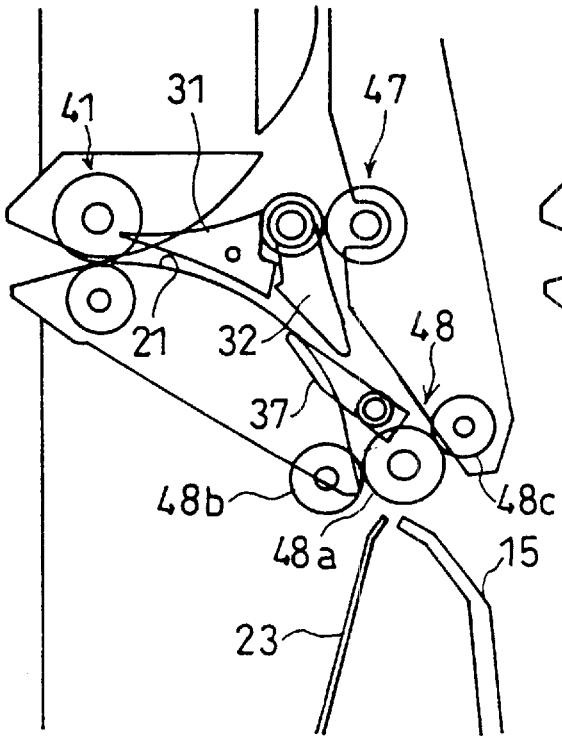
FIG. 7(*a*) is an explanatory view illustrating a switched state of the feed-in gate, the reversing gate, and the switching gate, in the case where three associated rollers are used as the reversing rollers in the sheet post-processing device shown in FIG. 1, and in the case where the stapling operation is applied to sheets of paper smaller than the letter size.
Figure 7B:
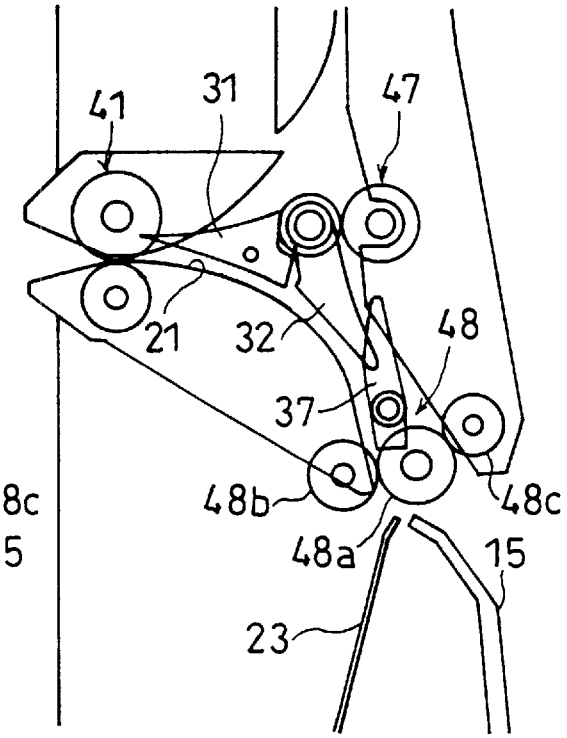
Figure 7C:
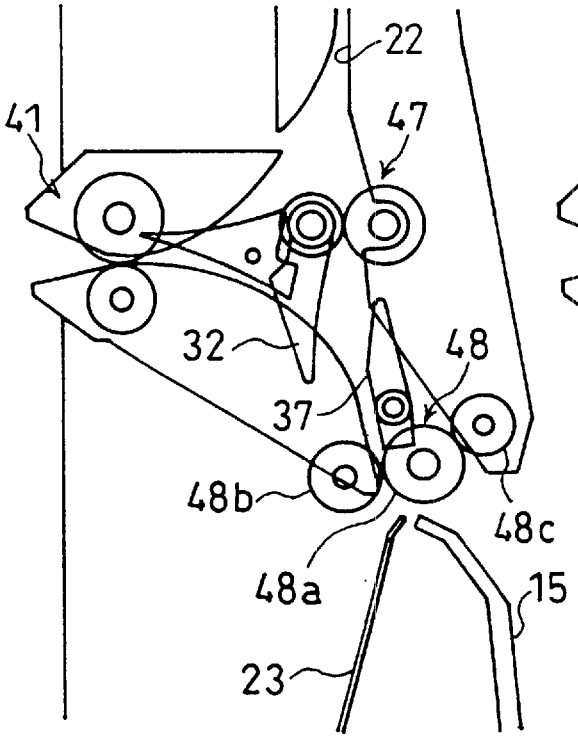
Figure 7D:
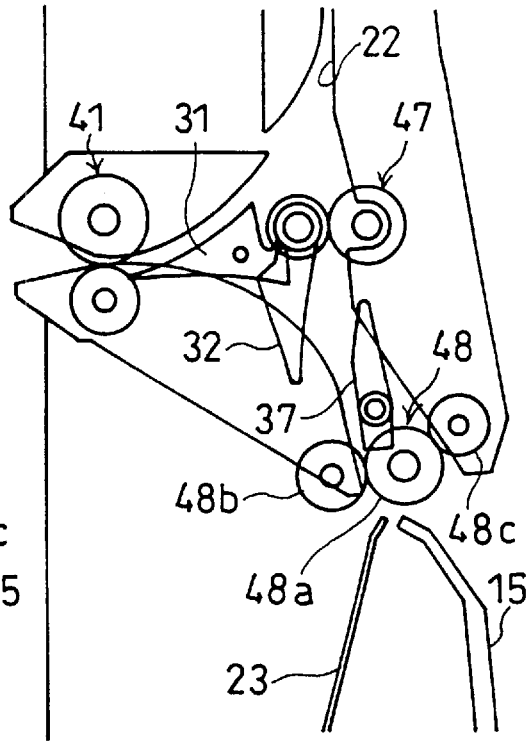

Sheets of paper discharged from the feed-out opening 3 of the copying machine 2 are fed through the feed-in opening 4 into the sheet post-processing device 1, and are transported to the direct path 21 inside the sheet post-processing device 1 by the feed-in rollers 41. Thereafter, the sheets transported through the direct path 21 pass through the gap G of the staple tray 10, guided by the reversing rollers 42 rotating in the non-reverse direction and the switching gate 33. Then, as shown in FIG. 6(*a*), sheets of paper are subsequently stacked on the lower staple tray 15, entering therein through the upper end of the lower staple tray 15. Thus, a stack of paper P is formed.

Here, since the size thereof is smaller than the letter size, the sheets of paper do not project out of the lower staple tray 15. Besides, as shown in the figure, when the sheets are stacked, the switching gate 34 is turned to such a position that the stack of paper P are sent to the stapler 59.

Then, when the stack of paper P composed of the predetermined number of sheets of paper is thus formed on ago the sheet supporter 55, the sheet supporter 55 causes the stack of paper P to lower to the stapling position, as shown in FIG. 6(*b*). Then, as guided by the switching gate 34, the stack of paper P is moved to the stapler 59, where the stapling operation is applied to the stack of paper P.

When the stapling operation by the stapler 59 finishes, the sheet supporter 55 rises as shown in FIG. 6(*c*), so that the stack of paper P is returned to a recessional position higher than the switching gate 34. Thereafter, the switching gate 34 is turned to such a position that the sheets of paper are discharged to the offset tray discharge path 27.

Then, as shown in FIG. 6(*d*), the sheet supporter 55 lowers, and the stack of paper P is transported to the offset tray discharge path 27, guided by the switching gate 34. In the transporting operation, the transport rollers 43 on the upstream side to the switching gate 34 rotate while pressing the stack of paper P. Thereafter the stack of paper P is fed out to the offset tray 11 through the offset tray discharge path 27 by the feed-out roller 44.

The following description will explain the operation and transport path of the sheet post-processing device 1 in the case where the paper size is greater than the letter size. The transport path in this case takes the following route, in FIG. 2: the direct path 21—the reversing path 23—the connecting path 24—the detour path 22—the staple tray 10 (the upper staple tray 14 and the lower staple tray 15)—the offset tray discharge path 27—the offset tray 11. Further, in this case, the feed-in gate 31, the reversing gate 32, and the switching gate 33 are turned as shown in FIG. 5(*b*).

Sheets of paper fed out of the feed-out opening 3 of the copying machine 2 are fed into the sheet post-processing device 1 through the feed-in opening 4, and the sheets are sent to the direct path 21 inside the sheet post-processing device 1, by the feed-in rollers 41. Thereafter, the sheets transported through the direct path 21 are sent to the reversing path 23, guided by the reversing rollers 42 rotating in the non-reverse direction and by the switching gate 33.

Then, when a rear edge of each sheet transported through the reversing path 23 passes the reversing gate 32, the reversing gate 32 is turned as shown in FIG. 5(*c*). At the switching operation, simultaneously the rotational direction of the reversing rollers 42 is switched to the reverse direction. With these switching operations, the sheets are sent from the reversing path 23 to the detour path 22. Note that the rear edge of the sheet means an edge which is rear when the sheet is discharged from the copying machine 2.

Thus, in the case where the size of the paper is great, the sheets of the paper fed from the copying machine 2 are once switched back by using the reversing path 23, and the sheets are sent through the connecting path 24 to the detour path 22, with the rear edge going in front.

The sheets of paper sent to the detour path 22 pass the whole detour path 22, thereby being sent to the staple tray 10 through the lower end thereof, and are stacked therein. In this operation, the driving roller 43*a* and the driven roller 43*c* of the transport rollers 43 are used. Since the paper is greater than the letter size, the sheets of paper stacked in the staple tray 10 are supported by the upper staple tray 10 and the lower staple tray 15 both.

Incidentally, since the operation after the sheets of paper are stacked in the staple tray 10 is the same as that in the case where the paper size is smaller than the letter size, the description thereof is omitted.

As described above, in the case where the paper size is greater than the letter size, the direct path 21 and the gap G are not used but the detour path 22 is used, for the following reason.

More specifically, if the sheets of paper are sent through the direct path 21 to the staple tray 10, jamming occurs in the direct path 21. The reason is that since the sheet of paper is too long in the transport direction, the following occurs if the sheet of paper is fed through the gap G: the rear edge of the sheet of paper does not yet pass through the gap G when the front edge thereof reaches the sheet supporter 55. Therefore, in this case, the sheets of paper are sent to the staple tray 10 through the detour path 22.

The reason why switchback is performed by using the reversing path 23 before sending the sheets to the detour path 22 is as follows. In the copy mode, the sheets are sent from the copying machine 2 from the last page of the sheets. Therefore, in the case where the stapling operation is applied to the sheets of paper, the sheets are preferably stacked in a "face-up" state on the staple tray 10. The "face-up" state means a state in which image-formed surfaces thereof face an opposite side to the staple tray 10.

However, if the sheets of paper fed out of the copying machine 2 are sent directly to the staple tray 10 through the detour path 22, the sheets are stacked in a "face-down" state. Therefore, before sending the sheets to the detour path 22, switchback is performed by using the reversing path 23 so that the sheets ate stacked on the staple tray 10 in the face-up state.

Next, a case where the sheets are fed out without application of the stapling operation when the copying machine 2 is in the copy mode will be explained below.

In this case, the transport path takes the following route in FIG. 2, irrespective of the paper size: the direct path 21—the staple tray 10 (only the lower staple tray 15)—the offset tray discharge path 27—the offset tray 11.

More specifically, in this case, the sheets transported from the copying machine 2 are discharged onto the offset tray 11 one by one, without being stacked by the lower staple tray 15. Therefore, the sheet supporter 55 is kept at the lower position. The switching gate 34 is kept at such a position that the sheets are sent to the offset tray discharge path 27, that is, the position shown in FIG. 6(*d*).

(Facsimile-Mode and Print-Mode Operations)

The following description will explain operations and transport paths when the copying machine 2 is in the facsimile mode or in the print mode.

First of all, the following description will explain a case where the stapling operation is not applied to the sheets of paper. Incidentally, in such a case, the sheets fed out of the sheet post-processing device 1 are discharged onto the upper fixed tray 12 in the case of the facsimile mode, while onto the lower fixed tray 13 in the case of the print mode.

As described above, since the sheets of paper are fed out from the last page when the copying machine 2 is in the copy mode, the sheets are discharged onto the offset tray 11 in the face-up state. On the other hand, when the copying machine 2 is in the facsimile mode or the print mode, the sheets are fed out of the copying machine 2 from the top page. Therefore, in such a case, if the sheets of paper are fed out of the sheet post-processing device 1 in the face-up state, the order of pages is reverse on the tray 12 or 13.

Therefore, in the facsimile mode or the print mode, the sheets are switched back once before being discharged onto the tray 12 or 13, so that the sheets are discharged in the face-down state.

More specifically, in the case where the stapling operation is not applied to the sheets of paper in the case of the facsimile mode, the transport path takes the following route in FIG. 2: the direct path 21—the reversing path 23—the connecting path 24—the detour path part 22*a*—the upper fixed tray discharge path 25 the upper fixed tray 12. Further, in the case of the print mode, the transport path takes the following route in FIG. 2: the direct path 21—the reversing path 23 the connecting path 24—the detour path part 22*a*—the detour path part 22*b*—the lower fixed tray discharge path 26—the lower fixed tray 13.

Thus, in the case of the facsimile mode or the print mode, the sheets of paper fed from the copying machine 2 are once sent to the reversing path 23 so as to make a switchback, and thereafter, they are sent to the detour path 22. Incidentally, the operation for switchback is the same as that in the case where the stapling operation is applied to the sheets of paper greater than the letter size when the copying machine 2 is in the copy mode.

The sheets of paper sent to the detour path 22 are discharged halfway the detour path 22 onto the upper fixed tray 12 or the lower fixed tray 13. More specifically, in the case of the facsimile mode, the feed-out gate 35 is turned so that the sheets are supplied from the detour path 22 to the upper fixed tray discharge path 25, thereby being fed out onto the upper fixed tray 12 by the feed-out rollers 45. On the other hand, in the case of the print mode, the sheets are supplied from the detour path 22 to the lower fixed tray discharge path 26 by the switching of the feed-out gate 36, thereby being discharged onto the lower fixed tray 13 by the feed-out rollers 46.

Next, a case where the stapling operation is applied to the sheets of paper will be explained below.

As described above, in this case as well, the printing and feeding-out operations are applied to the sheets of paper from the top sheet there among in the copying machine 2, and therefore, it is preferable that the sheets are stacked on the staple tray 10 in the face-down state.

For this reason, the sheets are directly sent to the detour path 22 through the feed-in opening 4, irrespective of the paper size, and are transported to the staple tray 10. This is because that the sheets cannot be stacked in the face-down state if the sheets are directly sent to the staple tray 15 through the direct path 21.

Therefore, the transport path in this case takes the following route in FIG. 2: the detour path 22—the staple tray 10 (only the lower staple tray 15, or both the upper and lower staple trays 14 and 15)—the offset tray discharge path 27—the offset tray 11. Further, in this case, the feed-in gate 31 is turned as shown in FIG. 5(*d*).

Incidentally, an operation after the sheets of paper are sent to the detour path 22 and then to the staple tray 10, and are discharged to the offset tray 11 after being stapled, is the same as that in the case where the sheets of paper greater than the letter size are stapled in the case of the copy mode.

Next, the following description will explain a case where the copying machine 2 has a large-capacity memory and is therefore capable of storing image data of the whole pages in the memory and hence printing and feeding out from the last page.

In this case, the transport path in the case where the stapling operation is performed takes the same route as that in the case of the copy mode. Therefore, if the paper size is not greater than the letter size, the transport path takes the following route: the direct path 21—the staple tray 10 (only the lower staple tray 15) the offset tray discharge path 27—the offset tray 11.

On the other hand, if the paper size is not smaller than the letter size, the transport path takes the following route: the direct path 21—the reversing path 23—the connecting path 24—the detour path 22—the staple tray 10 (the upper and lower staple trays 14 and 15)—the offset tray discharge path 27—the offset tray 11. Besides, the switching actions of the rollers and gates are the same as those in the case of the copy mode.

Further, in this case, even if the stapling operation is not performed, switchback of the sheets of paper is unnecessary. Therefore, the feed-in gate 31 is turned as shown in FIG. 5(*d*). The sheets supplied from the copying machine 2 are sent directly to the detour path 22 through the feed-in opening 4 without passing the reversing path 23, and thereafter, the sheets are discharged onto the upper fixed tray 12 or the lower fixed tray 13.

Incidentally, even if the copying machine 2 has a memory, the image data to be stored in the memory may exceed the capacity of the memory. In such a case, the copying machine 2 feeds out the sheets from the top page, and accordingly the operation of the sheet post-processing device 1 is the same as that in the case where the copying machine 2 does not have a memory.

As described above, the sheet post-processing device 1 in accordance with the present embodiment is arranged so that sheets of paper fed out from the copying machine 2 are stacked on the staple tray 10, and the sheets thus stacked are discharged after the stapling operation is applied thereto. Further, in the sheet post-processing device 1, the feed-in opening 4 and the staple tray 10 are formed so that the feed-in opening 4 is at a position not lower than the lower edge of the staple tray 10 and not higher than the upper edge of the staple tray 10.

More specifically, the staple tray 10 is composed of the upper staple tray 14 and-the lower staple tray 15, and the upper staple tray 14 is disposed above the feed-in opening 4 while the lower staple tray 15 is disposed below the feed-in opening 4.

Consequently, the positions of the staple tray 10 and the feed-in opening 4 in the sheet post-processing device 1 are less limited.

Further, it is possible to dispose the staple tray 10 in the vicinity of the upper part of the sheet post-processing device 1. Therefore, if the sheets of paper fed out of the staple tray 10 are discharged outside without bringing up, the offset tray 11 as the destination of the discharge can be positioned sufficiently high. As a result, the offset tray 11 is made to have a sufficient capacity.

Furthermore, inside the sheet post-processing device 1, the staple tray 10 is substantially perpendicularly disposed. With this arrangement, the width of the sheet post-processing device 1 can be reduced.

Furthermore, upon transport of sheets of paper to the staple tray 10, the direct path 21 and the detour path 22 are used. The detour path 22 goes around the upper edge of the upper staple tray 14 and is connected with the lower edge of the lower staple tray 15.

By so doing, even in the case where the width in the sheet transport direction of the sheet post-processing device 1 is set smaller, a radius of curvature of the curving part of the detour path 22 can be set sufficiently great. Therefore, the sheet post-processing device 1 is made to occupy a small space while to be capable of stable transport and post-processing operation with respect to a great number of sheets of paper.

Further, the sheet post-processing device 1 is equipped with three trays, namely, the offset tray 11, the upper fixed tray 12, and the lower fixed tray 13. Sheets of paper are supplied to upper fixed tray 12 through the upper fixed tray discharge path 25, to the lower fixed tray 13 through the lower fixed tray discharge path 26, and to the offset tray 11 through the offset tray discharge path 27, respectively.

With this arrangement, the sheet post-processing device 1 ensures that one is appropriately selected and used from among the trays 11 through 13 according to the operational mode of the copying machine 2.

Further, the upper fixed tray discharge path 25 and the lower fixed tray discharge path 26 are provided at the upper part of the sheet post-processing device 1, forming paths branching out from the detour path 22. Therefore, spaces for discrete paths to the trays 12 and 13 are unnecessary.

Therefore, the trays 12 and 13 can be provided at as upper positions as possible in the sheet post-processing device 1. Furthermore, this enables to provide the offset tray 11 at an upper position as well. Therefore, the capacity of the offset tray 11 can be made further greater.

Furthermore, the offset tray discharge path 27 is provided in a lower part of the sheet post-processing device 1, forming a path extending from the lower edge of the lower staple tray 15 to the offset tray 11. Therefore, since there is no need to bring up sheets of paper upward, the driving system including the transport rollers for discharging the sheets to the offset tray 11 can be made simpler.

Furthermore, the sheet post-processing device 1 is equipped with a reversing path 23 for sending the sheets of paper to the detour path 22 after reversion (switchback). The reversing path 23 is substantially perpendicularly formed between the lower staple tray 15 and the feed-in opening 4. The reversing path 23 is formed so that an upper part thereof and a lower part of the detour path part 22a substantially fall on one straight line.

Thus, since the reversing path 23 is perpendicularly formed, it is possible to suppress an increase in the width of the sheet post-processing device 1 even in the case where the reversing path 23 is disposed in the sheet post-processing device 1. Besides, since the upper part of the reversing path 23 and the lower part of the detour path part 22*a* are substantially on one straight line, transport jamming scarcely occurs upon reversion (switchback) of the sheets of paper.

Furthermore, the sheet post-processing device 1 includes the direct path 21 for sending the sheets of paper supplied from the feed-in opening 4 directly to the staple tray 10 without using the detour path 22. Further, the gap G is provided between the upper staple tray 14 and the lower staple tray 15 which compose the staple tray 10. The gap G serves as a sheet passing opening for guiding the sheets of paper thus transported through the direct path 21 toward the sheet-carrying surface of the staple tray 10.

By so doing, sheets of small-size paper (not greater than the letter size in the present embodiment) or sheets of paper to which the stapling operation is not applied are discharged onto the offset tray 11 without using the detour path 22, i.e., through a shorter transport path.

Furthermore, a time since a copying operation starts till the first sheet of paper is discharged, that is, a time for the first copy, can be shortened. Moreover, since the sheets of paper can be transported without going through the detour path 22 which curves, it is possible to reduce the occurrence of transport jamming.

Incidentally, in the sheet post-processing device 1, to guide the sheets of paper transported through the direct path 21 to the reversing path 23 or the lower staple tray 15, the switching gate 33 shown in FIGS. 5(*a*)through 5(*d*). However, in the place of the switching gate 33 and the reversing rollers 42, reversing rollers (second reversing rollers) 48 and a switching gate (second switching gate) 37 may be provided as the fed-in sheet transport destination switching section.

FIGS. 7(*a*)through 7(*d*)are explanatory views illustrating an arrangement and operations of the reversing rollers 48 and the switching gate 37. As shown in the figures, the reversing rollers 48 are three rollers associated with each other, namely, a driving roller 48*a* and driven rollers 48*b* and 48*c* (first and second driven rollers). The switching gate 37 is a gate provided on an upstream side to the reversing rollers 48, or more specifically, between the reversing gate 32 and the reversing rollers 48.

With the foregoing arrangement, the sheets supplied through the direct path 21 are guided by the switching gate 37 either to the reversing path 23 or to the lower staple tray 15.

In the case where the sheets are sent from the direct path 21 to the lower staple tray 15 in the foregoing arrangement, the feed-in gate 31, the reversing gate 32, and the switching gate 37 are turned as shown in FIG. 7(*a*).

In the case where the sheets are sent from the direct path 21 to the reversing path 23, the feed-in gate 31, the reversing gate 32, and the switching gate 37 are turned as shown in FIG. 7(*b*).

Then, in the case where the sheets supplied to the reversing path 23 are reversed and sent to the detour path 22, the reversing gate 32 is turned as shown in FIG. 7(*c*). Furthermore, in the case where the sheets are directly sent to the detour path 22, the feed-in gate 31 is turned as shown in FIG. 7(*d*).

Thus, according to the arrangement shown in Figures 7(*a*)through 7(*d*), the reversing rollers 48, that are the three associated rollers, serve as both (1) the pair of rollers which are capable of rotating both in nonreversal and reversal directions for feeding sheets of paper into and out of the reversing path 23, and (2) the pair of transport rollers for transporting sheets of paper to the gap G as the sheet passing opening of the staple tray 10.

With the foregoing arrangement, the reversing path 23 and the gap G can be disposed close to each other. Therefore, with the foregoing arrangement, an increase in the width of the sheet post-processing device 1 in the sheet transport direction can be suppressed.

Furthermore, regarding the arrangement shown in FIGS. 7(*a*)through 7(*d*), it is preferable that the reversing rollers 48 are solely driven by the reversing motor 60, like the reversing rollers 42 shown in FIG. 3 and the like. Besides, regarding the foregoing arrangement, it is preferable that all the other rollers are driven by the transport motor 61. By such arrangement, the driving system of the transport rollers can be simplified.

Furthermore, in the sheet post-processing device 1, to guide the sheets of paper transported through the direct path 21 either to the reversing path 23 or to the lower staple tray 15, there is no need to use the switching gate 33, the switching gate 37, or the like. Alternatively, the arrangement shown in FIGS. 7(*a*) through 7(*d*)may be modified so that an inclining angle of the reversing path 23 and the lower staple tray 15 is changeable (the reversing path 23 and the lower staple tray 15 can be inclined).

Figure 8B:
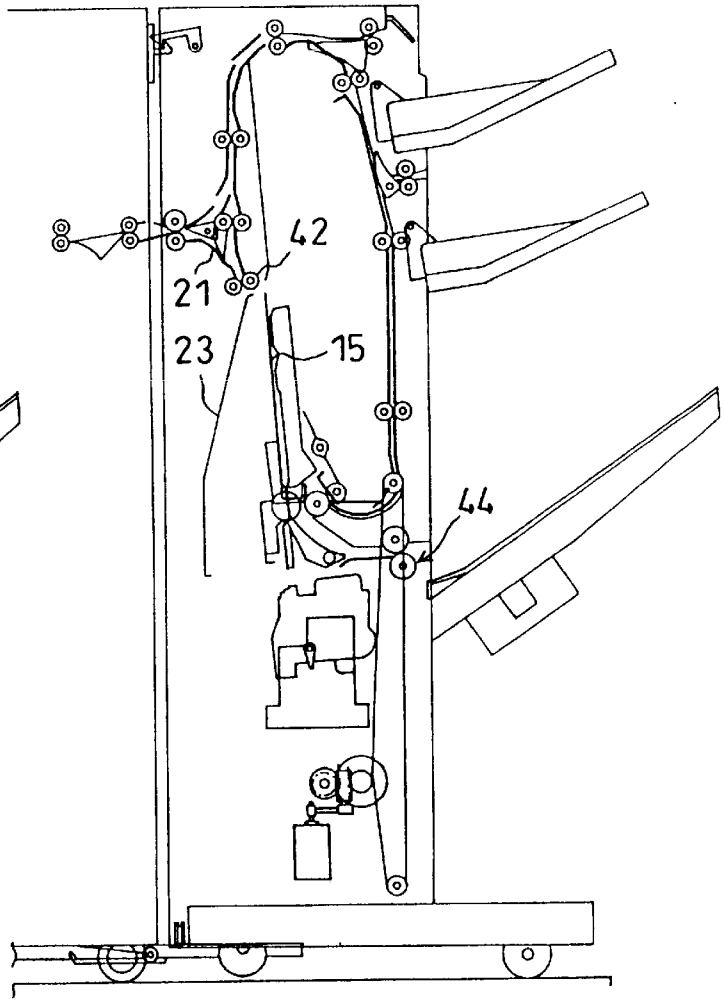
FIG. 8(*a*) is an explanatory view illustrating a state of sheet transportation in which the sheets of paper supplied from the copying machine are sent to the lower staple tray, in the case where the reversing path and the lower staple tray of the sheet post-processing device shown in FIG. 1 are arranged so as to be pivotable.
Figure 8A:
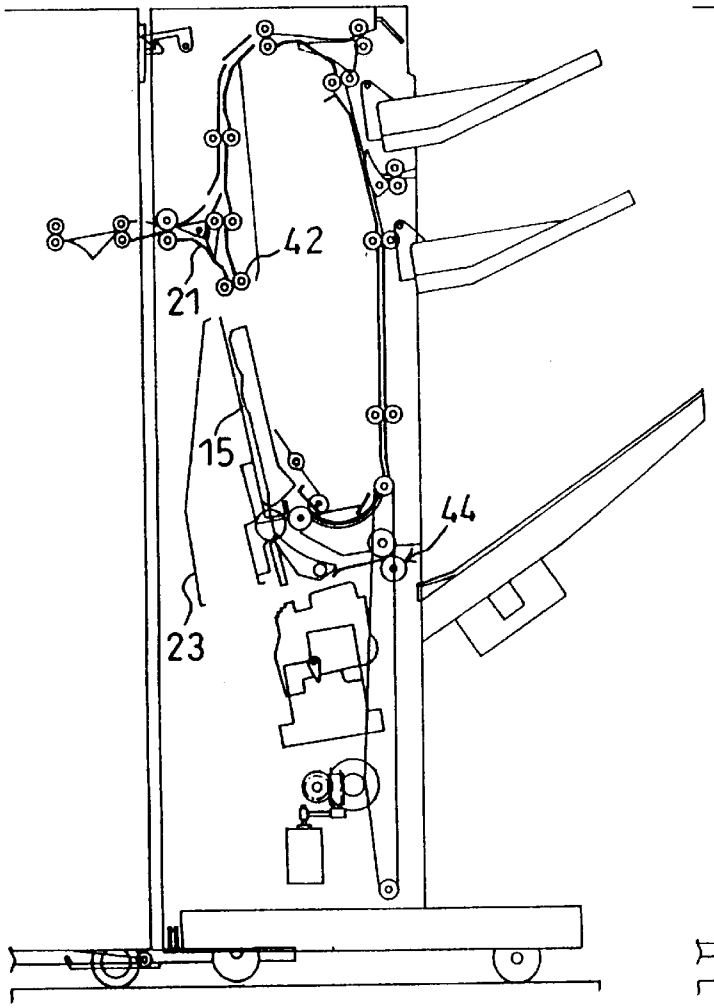

FIGS. 8(*a*) and 8(*b*) are explanatory views showing operations in the foregoing arrangement. With the foregoing arrangement, in the case where sheets of paper are sent from the direct path 21 to the lower staple tray 15, the upper edge of the lower staple tray 15 is caused to come right below the reversing rollers 42, as shown in FIG. 8(*a*).

On the other hand, in the case where sheets of paper are sent from the direct path 21 to the reversing path 23, or from the reversing path 23 to the detour path 22, the inclining angles of the reversing path 23 and the lower staple tray 15 are changed so that the upper end of the reversing path 23 is caused to come right below the reversing rollers 42, as shown in FIG. 8(*b*).

Incidentally, with the foregoing arrangement, the actions of the feed-in gate 31 and the reversing gate 32 are completely the same as those shown in FIGS. 5(*a*) through 5(*d*).

With the foregoing arrangement, in the case where the sheets of paper are guided from the direct path 21 to the lower staple tray 15, the lower staple tray 15 is pivoted, and in so doing, a space on the sheet-carrying surface side of the lower staple tray 15 is made larger, whereby the stacking capacity of the lower staple tray 15 can be expanded.

Incidentally, with the arrangement shown in FIGS. 8(*a*) through 8(*b*), the reversing path 23 and the lower staple tray 15 may be provided in a unit including the stapler 59 and the offset tray discharge path 27 as well.

Furthermore, according to the arrangement shown in FIGS. 8(*a*) through 8(*b*), to change the inclining angles of the reversing path 23 and the lower staple tray 15, the whole unit is revolved around the discharge rollers 44 as an axis of revolution. However, inclining angles of only the reversing path 23 and the lower staple tray 15 may be changeable.

According to the present embodiment, in the case where the stapling operation is not applied to sheets of paper, used as the discharge tray is the offset tray 11 in the case of the copy mode, the upper fixed tray 12 in the case of the facsimile mode, and the lower fixed tray 13 in the case of the print mode, but the combinations of the mode and the discharge tray are not limited to them. The combination of the mode and the discharge tray may be desirably set by the user.

Furthermore, the staple tray 10 of the sheet post-processing device 1 may be formed so as to perpendicularly extend.

Furthermore, the reversing path 23 may be formed so that a junction part thereof with the detour path 22 becomes substantially straight. By this arrangement, transport jamming of sheets of paper during the reversing operation scarcely occurs.

Furthermore, the arrangement of the sheet post-processing device 1 in accordance with the present embodiment is merely one example of the arrangement of the sheet post-processing device of the present invention. The present invention is applicable to the following various sheet post-processing devices.

Figure 9:
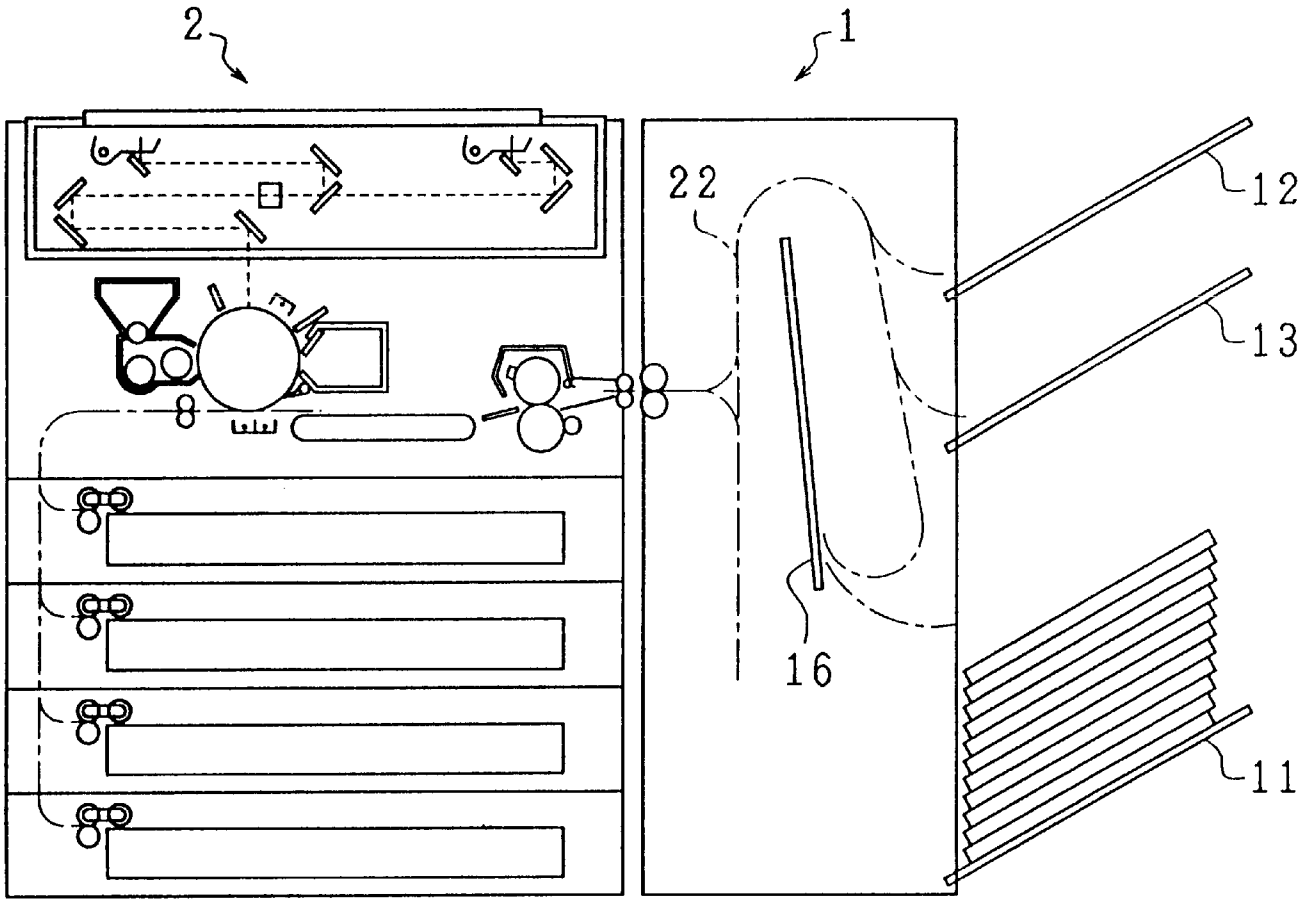
FIG. 9 is an explanatory view illustrating a schematic arrangement of another sheet post-processing device in accordance with the first embodiment of the present invention and a copying machine connected to the sheet post-processing device.

For example, in the sheet post-processing device 1 shown in FIG. 1, the staple tray 10 divided into two trays, namely, the upper fixed tray 12 and the lower fixed tray 13, is used as the post-processing tray. However, the arrangement of the sheet post-processing device 1 is not limited to this. For example, as shown in FIG. 9, a staple tray 16 which is not divided may be used as the post-processing tray. In this arrangement, the direct path 21 is unnecessary.

Figure 10:
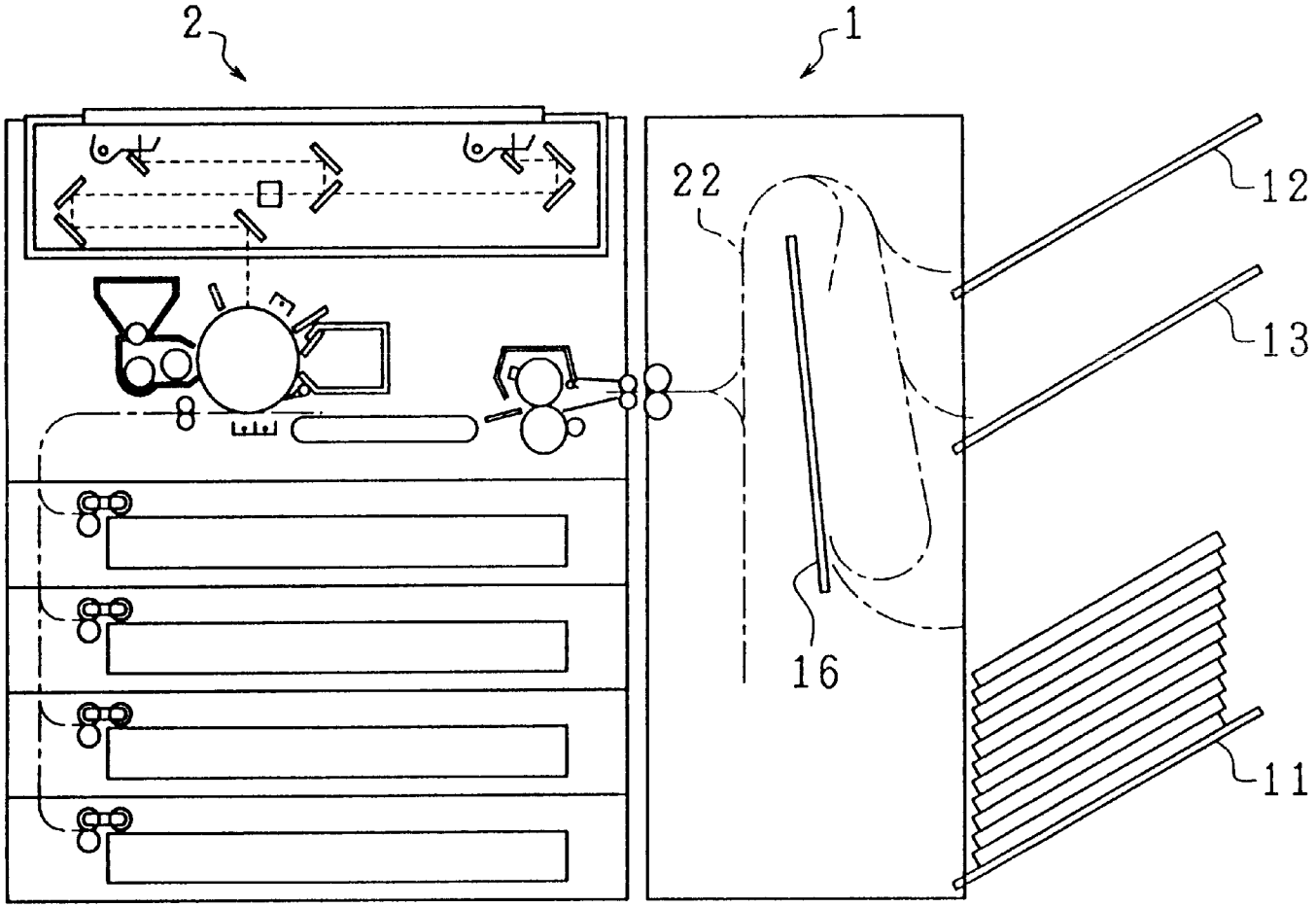
FIG. 10 is an explanatory view illustrating a schematic arrangement of still another sheet post-processing device in accordance with the first embodiment of the present invention and a copying machine connected to the sheet post-processing device.

In the sheet post-processing device 1 shown in FIG. 1, sheets of paper are supplied through the detour path 22 going around the upper edge of the staple tray 10, so that the sheets are supplied to the staple tray 10 from the lower edge side. However, the arrangement of the sheet post-processing device 1 is not limited to this. For example, as shown in FIG. 10, the detour path 22 may go around an edge of the staple tray 10 or 16 so that sheets of paper are supplied to the staple tray 10 or 16 through the edge (upper edge) of the staple tray 10 or 16 that the detour path 22 goes around.

Furthermore, in the sheet post-processing device 1 shown in FIG. 1, the staple tray 10 is substantially perpendicularly provided inside the sheet post-processing device 1, but the provision of the staple tray 1 is not limited to this. The staple tray 10 is preferably provided in the sheet post-processing device 1 with such an inclination that a length of the staple tray 10 projected on a vertical plane (a plane whose normal line is directed in the horizontal direction) is greater than a length of the staple tray 10 projected on a horizontal plane. In other words, the staple tray 10 is disposed so that a vertical direction component of the length of the staple tray 10 is greater than a horizontal direction component thereof. By so disposing the staple tray 10, the width of the sheet post-processing device 1 in the horizontal direction can be reduced.

Figure 11:
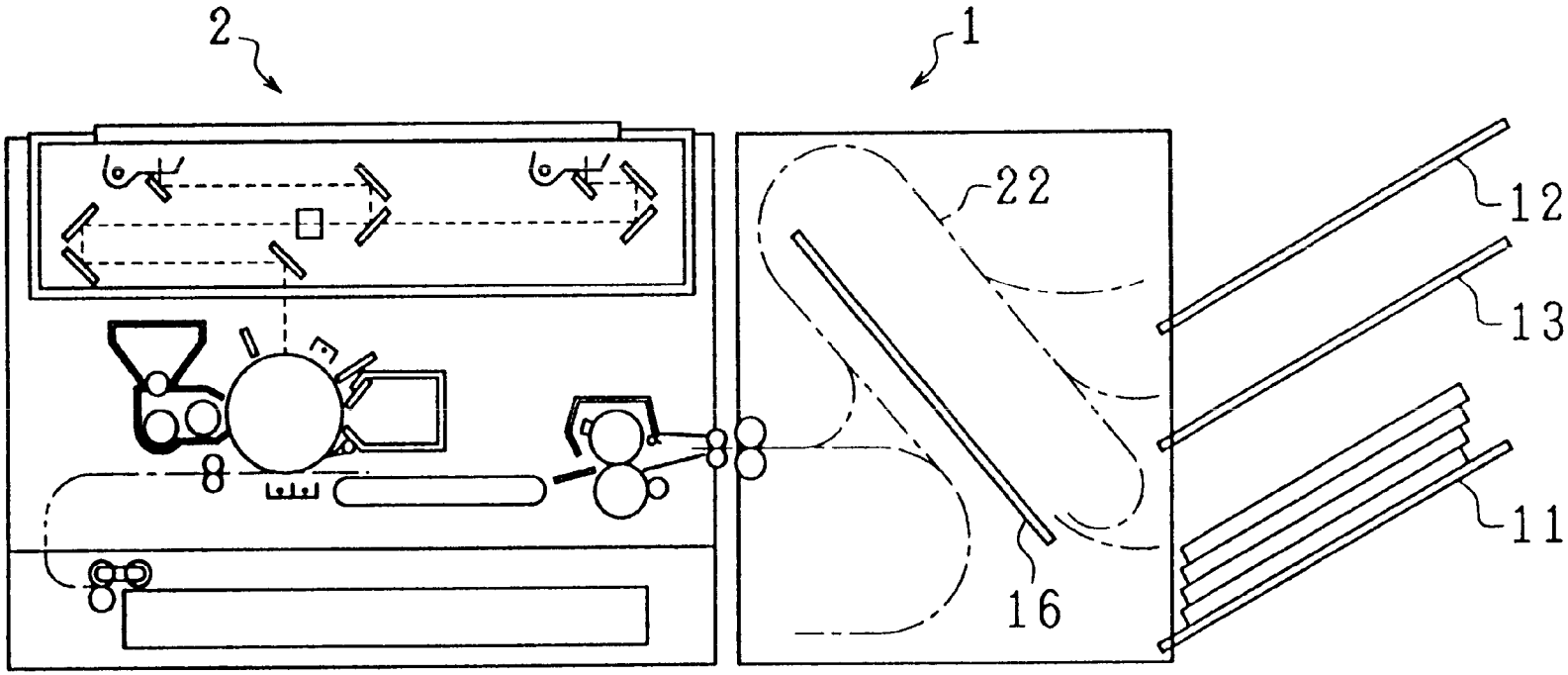
FIG. 11 is an explanatory view illustrating a schematic arrangement of still another sheet post-processing device in accordance with the first embodiment of the present invention and a copying machine connected to the sheet post-processing device.
Figure 12:
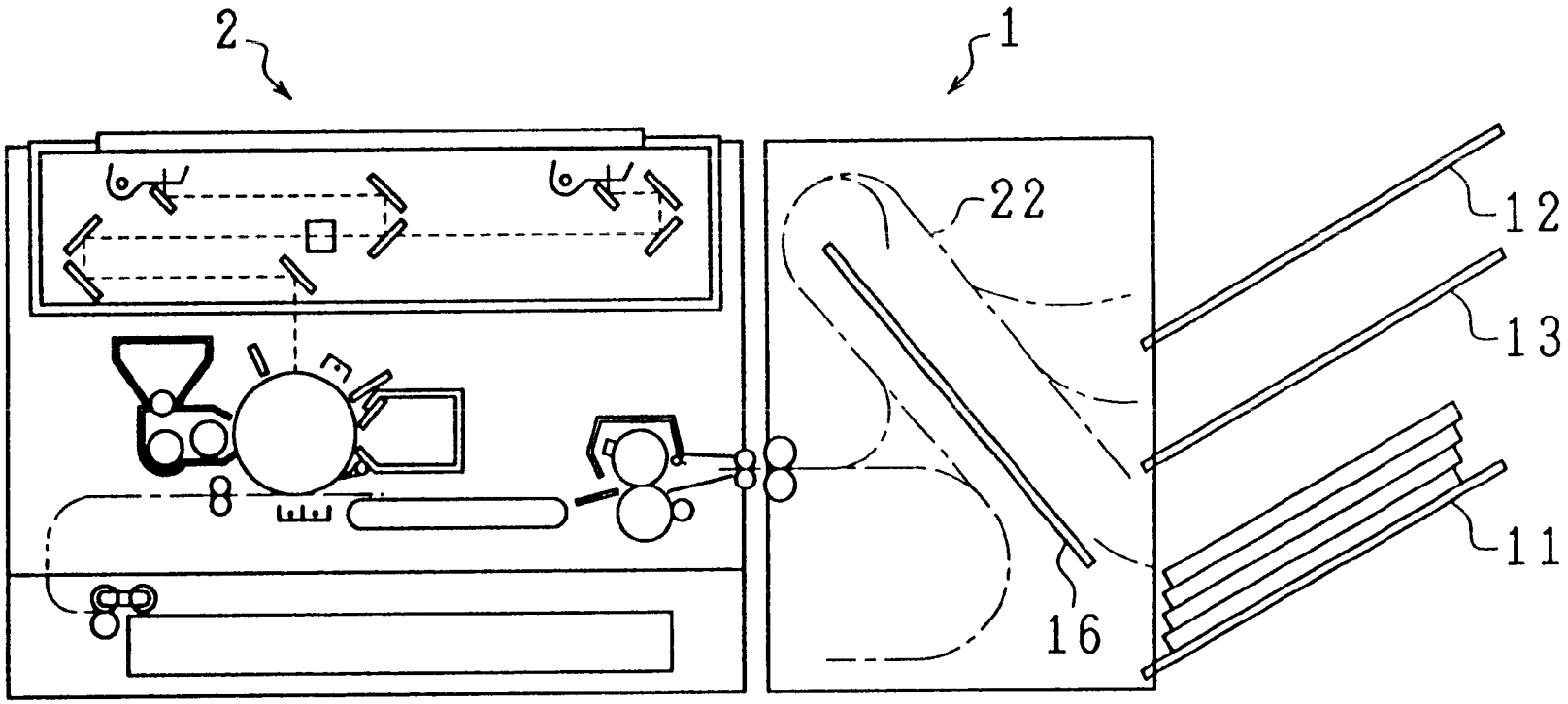
FIG. 12 is an explanatory view illustrating a schematic arrangement of still another sheet post-processing device in accordance with the first embodiment of the present invention and a copying machine connected to the sheet post-processing device.
Figure 13:
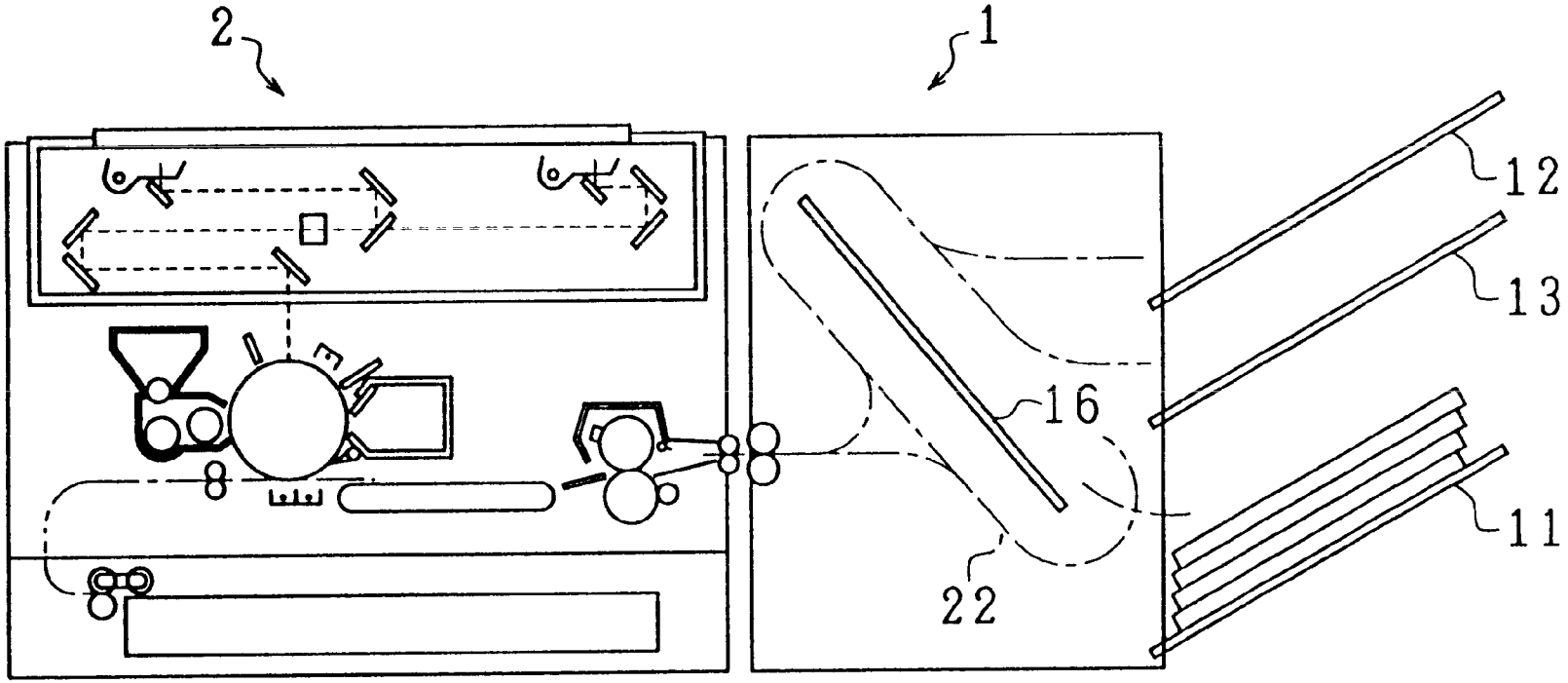
FIG. 13 is an explanatory view illustrating a schematic arrangement of still another sheet post-processing device in accordance with the first embodiment of the present invention and a copying machine connected to the sheet post-processing device.

Furthermore, for example, as shown in FIGS. 11 through 13, the staple tray 10 or 16 may be inclined so that the length of the staple tray 10 or 16 projected on the horizontal plane is greater than the length thereof projected on the vertical plane.

Figure 14:
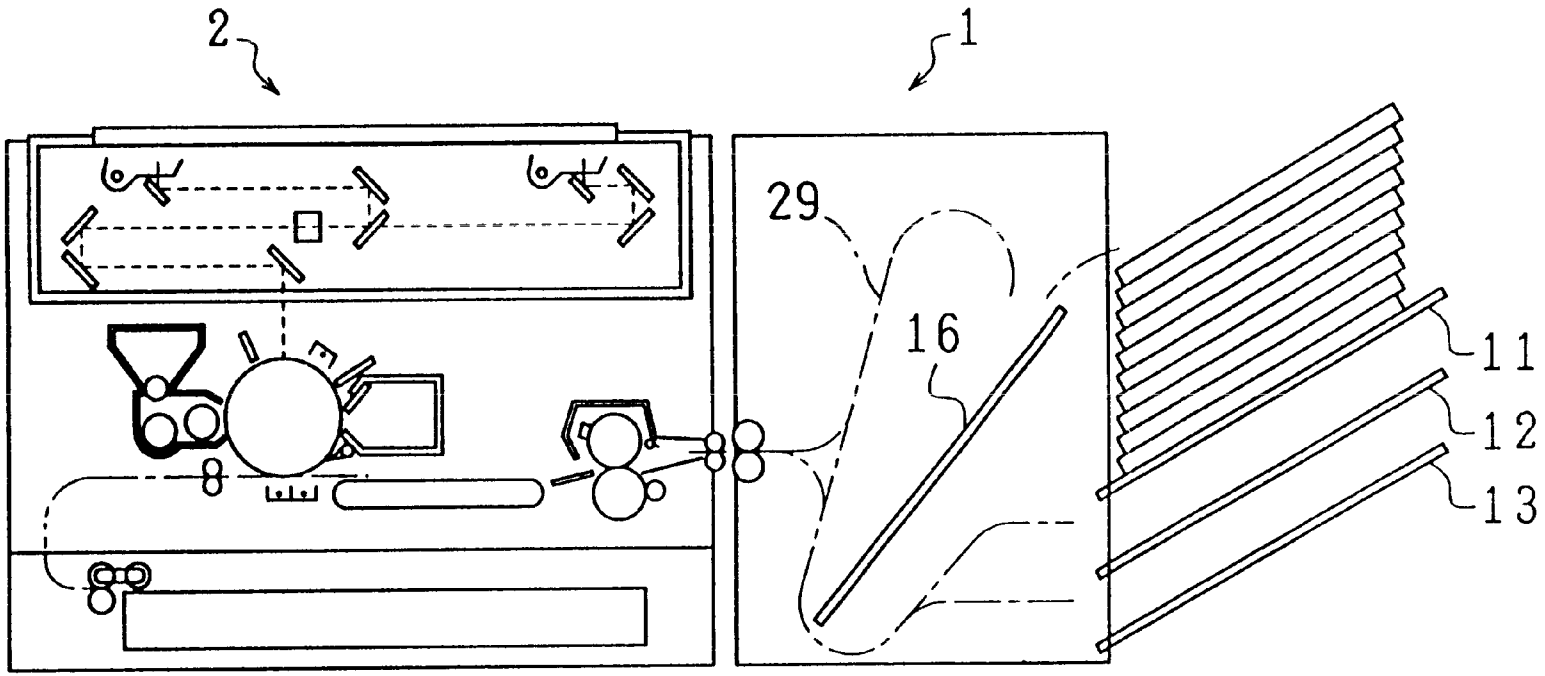
FIG. 14 is an explanatory view illustrating a schematic arrangement of still another sheet post-processing device in accordance with the first embodiment of the present invention and a copying machine connected to the sheet post-processing device.

Furthermore, as shown in FIG. 14, the sheet post-processing device 1 may be arranged so that instead of the detour path 22, a feed-in path 29 may be provided as the path for transporting sheets of paper to the staple tray 10 or 16. As shown in the figure, the feed-in path 29 does not go around an edge of the staple tray 10 or 16.

However, note that with the foregoing arrangement, if the staple tray 10 or 16 is nearly perpendicularly disposed, a radius of curvature of the curving part of the feed-in path 29 becomes small. For this reason, with the foregoing arrangement, the staple tray 10 or 16 is preferably disposed with a certain inclination.

Furthermore, as shown in FIG. 14 also, the sheet post-processing device 1 may be provided so as to feed out sheets of paper through the upper edge of the staple tray 10 or 16.

According to the arrangements as shown in FIGS. 9 through 13 wherein stapled sheets of paper are fed out through the lower edge of the staple tray 10 or 16, the offset tray 11 on which the stapled sheets are discharged can be made to have a sufficient capacity, without setting the sheet feed-out opening of the copying machine 2 to a high position in the copying machine 2.

Furthermore, with the arrangement as shown in FIG. 14 wherein stapled sheets of paper are discharged through the upper edge of the staple tray 10 or 16, instability of the device due to the provision of the staple tray 10 or 16 at a high position can be reduced, without setting the feed-out opening 3 of the copying machine 2 at a lower position.

Thus, the sheet post-processing device 1 as shown in FIGS. 9 through 14 is made flexible with the height of the feed-out opening 3 of the copying machine 2. Further, the sheet post-processing device 1 is arranged so that the dimensions in the horizontal direction and in the vertical direction can be reduced.

[Second Embodiment]

The following description will explain a second embodiment of the present invention. The members having the same structure (function) as those in the first embodiment will be designated by the same reference numerals and their description will be omitted.

The following description about the present embodiment will explain a system (stapling system) for performing the stapling operation by the sheet post-processing device 1 shown in FIG. 1. The arrangement and function of the stapling system is explained in the description of the first embodiment, and the following description of the present embodiment will further explain the same in more detail.

Figure 15:
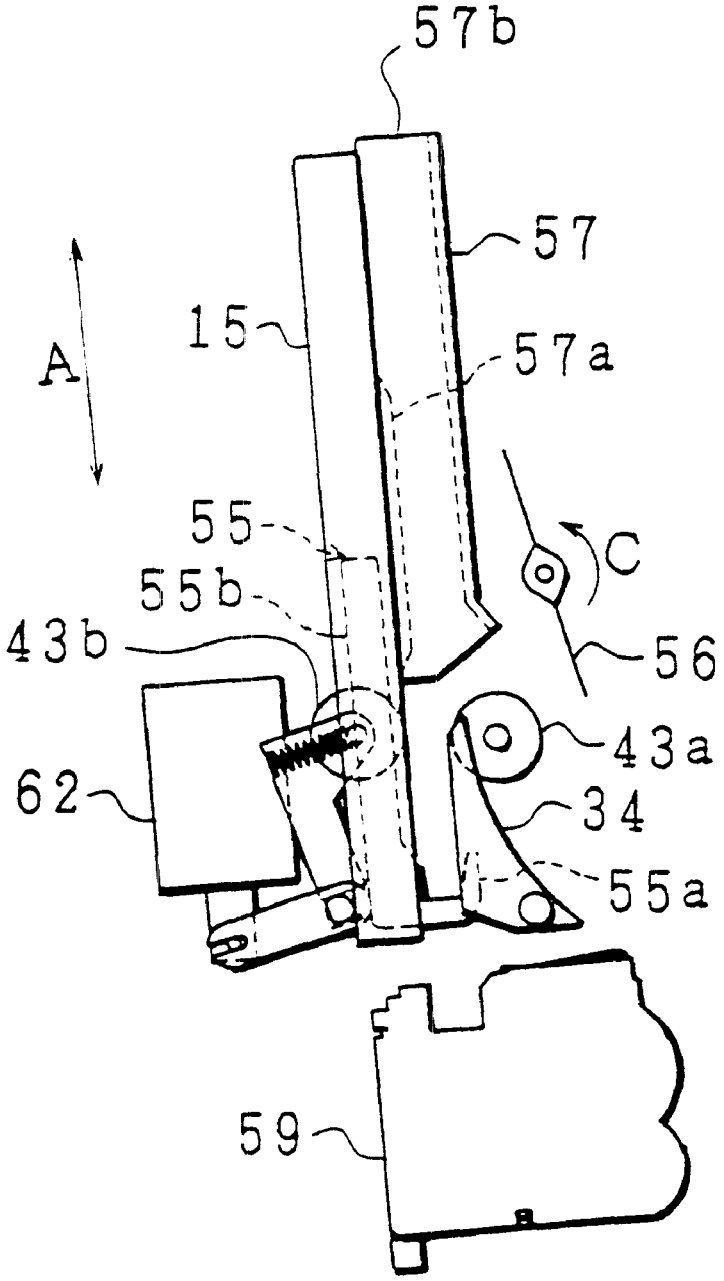
FIG. 15 is a side view illustrating an arrangement of a stapling system of the sheet post-processing device shown in FIG. 1.
Figure 16:
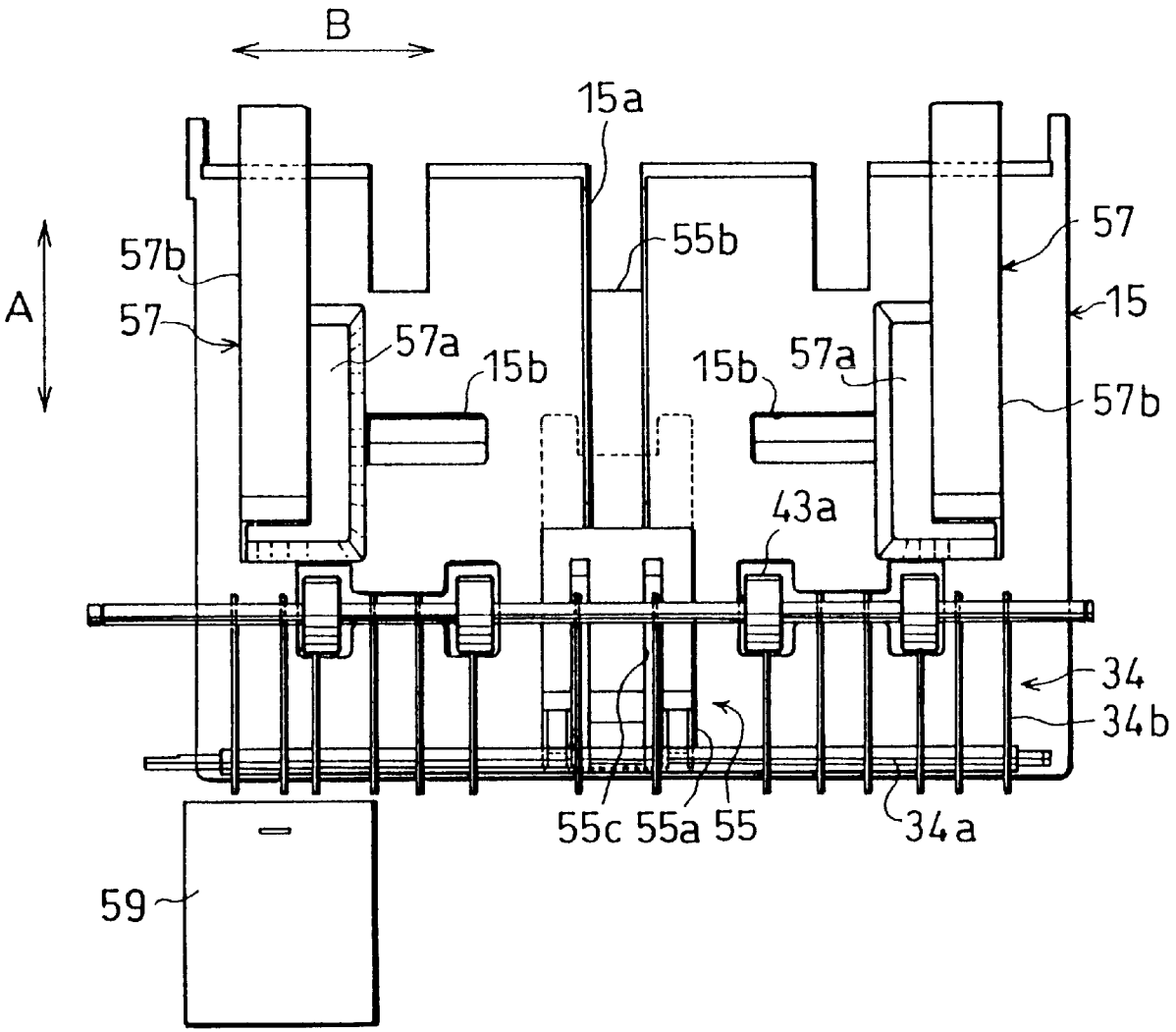
FIG. 16 is a front view illustrating an arrangement of the stapling system shown in FIG. 15.

First of all, the arrangement of the stapling system is explained below. FIG. 15 is a side view of the stapling system, and FIG. 16 is a front view of the same. As shown in these figures, the lower staple tray 15 is equipped with the sheet supporter (sheet carrying member) 55, the paddler 56, and the adjusting plates (sheet adjusting members) 57. Then, the sheet supporter 55 and the adjusting plates 57 are provided to the lower staple tray 15 so that each of the same can be slid along the lower staple tray 15.

The sheet supporter 55 is for adjusting the lower edge of stacked sheets of paper. The sheet supporter 55, in a state of carrying the stack of paper, is movable in an arrow A direction in the figure to a stacking position, a stapling position (post-processing position), a recessional position, and a discharge position which are predetermined, in order to move the stack of paper carried thereon to these positions.

The stacking position is a position at which sheets of paper are stacked by the lower staple tray 15. The stapling position is a position at which sheets of paper are stapled by the stapler 59.

The recessional position is a position to which stapled sheets of paper are moved after the stapling operation, and which is determined so that the stack of paper is positioned higher than the switching gate 34. The discharge position is a position of the stack of paper to be discharged onto the offset tray 11.

More specifically, when a predetermined sheets of paper are stacked on the sheet supporter 55 at the stacking position, the sheet supporter 55 is brought down to the stapling position at which the stack of paper is stapled by the stapler 59. After the stapling operation by the stapler 59, the sheet supporter 55 is brought up to the recessional position.

Figures 17, 17B, 17C:
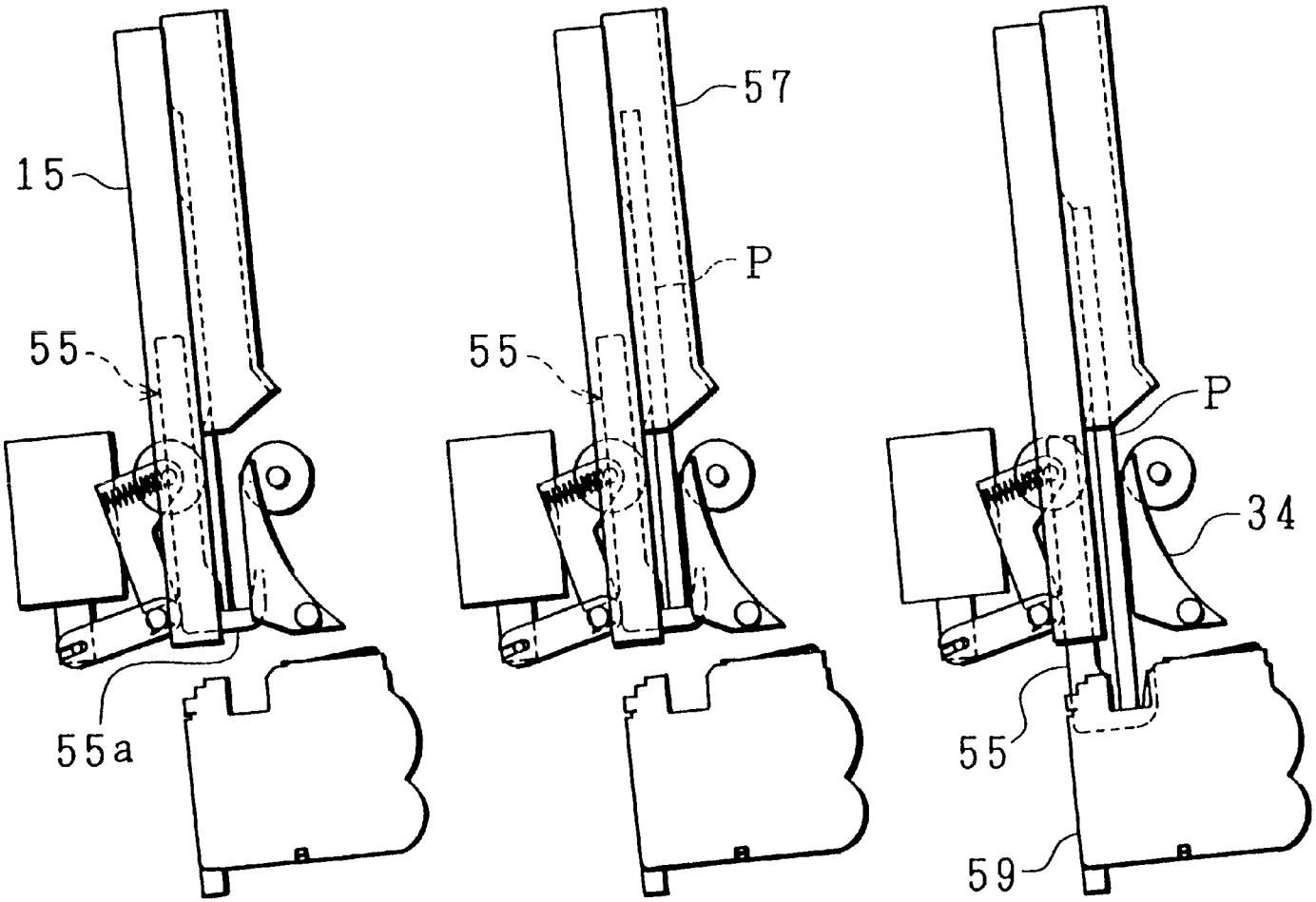
FIG. 17(*a*) is an explanatory view illustrating a state of a stapling operation by the stapling system shown in FIG. 15, in which sheets of paper are being stacked on a lower staple tray.

As shown in FIGS. 15 and 17, the sheet supporter 55 is composed of a sheet carrying part 55*a* and a interfitting part 55*b*. The interfitting part 55*b* interfits in a groove 15*a* formed in a vertical direction (indicated by the arrow A) in the lower staple tray 15. The interfitting part 55*b* slides along the groove 15*a*, so that the sheet supporter 55 moves in the A direction along the lower staple tray 15.

The sheet carrying part 55*a* is for supporting lower edges of the sheets, and has a cross section in a substantially angular-U shape. A surface of the sheet carrying part 55*a* which is in contact with the lower edges of sheets of paper is flat. By bringing the lower edges of sheets of paper in contact with the flat surface, the lower edges of the sheets are adjusted.

The paddler 56 is for supplying sheets of paper on the lower staple tray 15 with a transport force in a downward direction so as to facilitate the adjustment of the lower edges of the sheets of paper by the sheet supporter 55.

More specifically, the paddler 56 is arranged so as to make one full rotation in an arrow C direction in FIG. 15 every time one sheet is transported to the lower staple tray 15. With the rotation, the transport force in the downward direction is supplied to the sheets of paper, whereby the sheets are surely adjusted on the sheet supporter 55. This prevents the sheets of paper from becoming untidy on the sheet supporter 55 due to static electricity or the like.

The paddler 56 is equipped with blade sections for supplying the sheets of paper with a transport force. Examples of material for the blade sections include a flexible material made of an elastic substance such as rubber.

Incidentally, by making the sheet supporter 55 of a conductive material and grounding it so that charge accumulated in the sheets of paper is discharged, a further better result of adjustment can be obtained.

The adjusting plates 57 are for adjusting side edges of the sheets of paper stacked, and are shaped so as to be symmetrical. Before the sheets of paper are stacked, the adjusting plates 57 are positioned so that a space therebetween is widest. When a predetermined number of sheets are stacked on the lower staple tray 15, the adjusting plates 57 are moved in an arrow B direction in FIG. 16 in such a manner that the space therebetween becomes narrower. Then, by closing the adjusting plates 57 to the sheets of paper with the foregoing movement, the side edges are adjusted.

Each adjusting plate 57 is composed of a sheet platen 57*a* and a sheet guide part 57*b*. The sheet platen 57*a* includes a part interfitted in a groove 15*b* formed in a horizontal direction (the arrow B direction in FIG. 16) in the lower staple tray 15. The sheet platen 57*a* slides along the groove 15*b* so that the adjusting plate 57 moves in the arrow B direction.

The sheet guide part 57*b* is for guiding the sheets of paper supplied to the lower staple tray 15 to the sheet carrying part 55*a* of the sheet supporter 55, and has a cross section in a substantially L shape. Further, a surface of the sheet guide part 57*b* in contact with the side edges of sheets is flat. Therefore, by bringing the side edges of sheets of paper in contact with the foregoing surface, the side edges are adjusted. The sheet guide part 57*b* also has a function of keeping sheets stacked on the staple tray 10 from falling down.

Below the lower staple tray 15, the stapler 59 is disposed. The stapler 59 is movable in the arrow B direction in FIG. 16 along the lower edge of the stack of paper, thereby allowing the stapling operation to be applied with respect to any desired position of the lower edge part of the stack of paper. Needless to say, it is possible to apply the stapling operation with respect to a plurality of positions of the lower edge part of the stack of paper by moving the stapler 59.

In the vicinity of the lower edge of the lower staple tray 15, the switching gate 34 is disposed. The switching gate 34 is a gate used for switching a destination of the stack of paper between the stapler 59 and the offset tray 11, when the sheet supporter 55 is brought down.

As shown in FIG. 16, the switching gate 34 is formed in a comb shape, composed a rotation shaft 34*a* to which a plurality of gate plates 34*b* in a thin film form each are fixed. The lower staple tray 15 and the sheet supporter 55 have slits or the like so as not to interfere with the gate plates 34*b*.

In the vicinity of the switching gate 34, the transport rollers 43 composed of the driving rollers 43*a* and the driven rollers 43*b*. The driving rollers 43*a* and the driven rollers 43*b* are transport rollers for causing the stack of paper brought down together with the sheet supporter 55 to be fed out onto the offset tray 11 through the offset tray discharge path 27. In other words the driving rollers 43*a* and the driven rollers 43*b* are for supplying the transport force to the stack of paper, upon discharge of the stack of paper onto the offset tray 11.

Moreover, the driven rollers 43*b* are movably provided so as to be brought into contact with and be separated away from the sheets of paper stacked on the lower staple tray 15 under control of a solenoid 62 shown in FIG. 15. The driven rollers 43*b* are positioned at predetermined recessional positions, all the times except a stack of paper is discharged onto the offset tray 11. Therefore, when the sheet supporter 55 moves a stack of paper, the driven rollers 43*b* by no means obstruct the movement of the stack of paper.

The following description will explain an operation of the stapling system arranged as above. Incidentally, in the following description, a case where the copying machine 2 is in the copy mode and the paper size is not greater than the letter size will be explained. Note that in the other cases, the operation that the stapling system performs after a stack of paper P is obtained in the staple tray 10 is identical to the operation in the present case.

The transport path in this case is as follows in FIG. 2: the direct path 21—the staple tray 10 (only the lower staple tray 15)—the offset tray discharge path 27—the offset tray 11. In the foregoing case, the feed-in gate 31, the reversing gate 32, and the switching gate 33 are turned as shown in FIG. 5(*a*).

Sheets of paper ejected from the feed-out opening 3 of the copying machine 2 are fed into the sheet post-processing device 1 through the feed-in opening 4, and then, the sheets are sent to the direct path 21 inside the sheet post-processing device 1. Thereafter, the sheets transported through the direct path 21 pass the gap G of the staple tray 10, guided by the reversing rollers 42 rotating in the non-reverse direction and the switching gate 33.

Then, as shown in FIG. 17(*a*), the sheets are supplied to the lower staple tray 15 via the upper edge thereof and are stacked thereon. Here, since the size is not greater than the letter size, the sheets of paper by no means project out of the lower staple tray 15. Besides, the sheet supporter 55 is at such a position that the sheet carrying part 55*a* is positioned at a height substantially equal to that of the lower edge of the lower staple tray 15. Such a position is the stacking position of the sheet supporter 55. Here, the switching gate 34 is turned to such a position that the stack of paper P is sent toward the stapler 59.

Thus, sheets of paper supplied from the copying machine 2 are stacked, whereby a stack of paper P composed of a predetermined number of sheets of paper is formed on the sheet supporter 55, as shown in FIG. 17(*b*). The stack of paper P is subject to an adjusting operation by the adjusting plates 57 whereby the side edges of the stack of paper P are adjusted.

Figure 18:
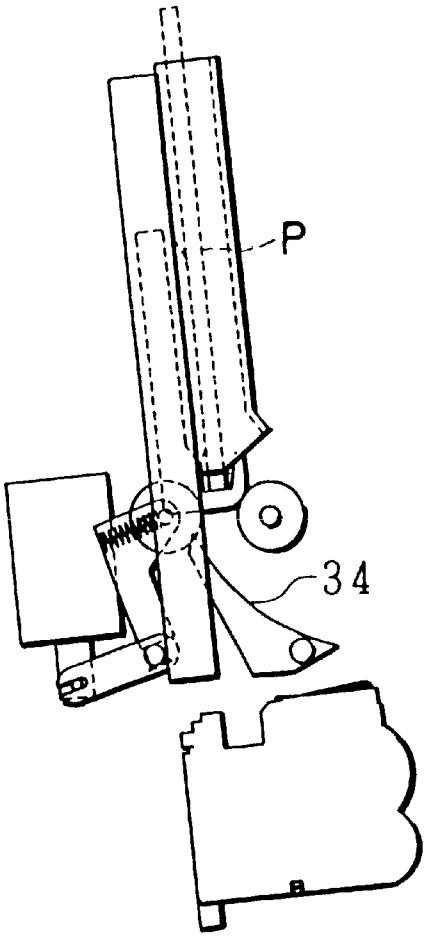
FIG. 18(*a*) is an explanatory view illustrating a state of the stapling operation by the stapling system shown in FIG. 15, in which a stapling operation by the stapler is applied to the stack of paper.
Figure 18:
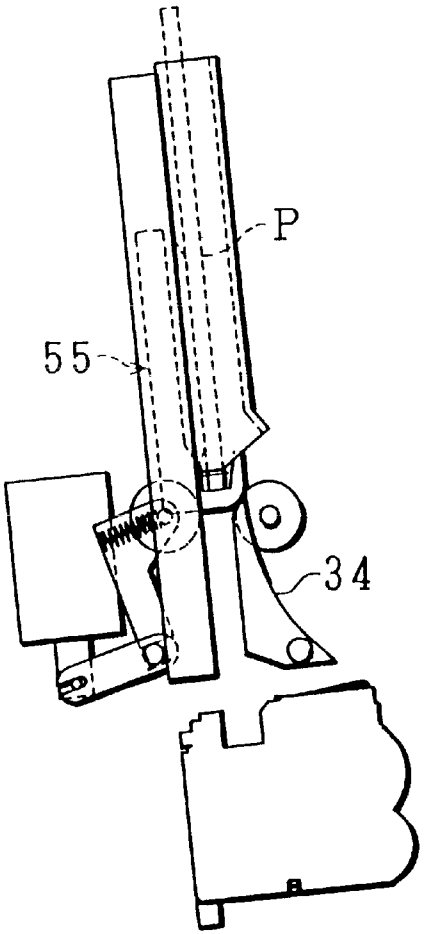
Figure 18:
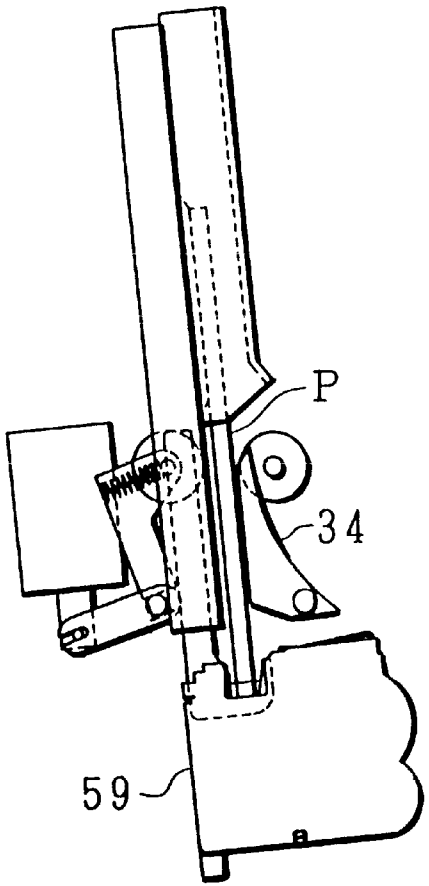

Thereafter, as shown in FIG. 17(*c*), the sheet supporter 55 descends, and the lower edge of the stack of paper P reaches to a staple opening of the stapler 59, guided by the switching gate 34. Then, as shown in FIG. 18(*a*), the stapling operation is applied to the lower edge part of the stack of paper P by the stapler 59. The foregoing position of the stack of paper P is the stapling position.

After the stapling operation of the stapler 59 finishes, the sheet supporter 55 rises, and as shown in FIG. 18(*b*), the stack of paper P is returned to a position higher than the switching gate 34. The foregoing position of the stack of paper P is the recessional position. The recessional position is a preferable position of the stack of paper P when the switching gate 34 is being turned.

Figure 19C:
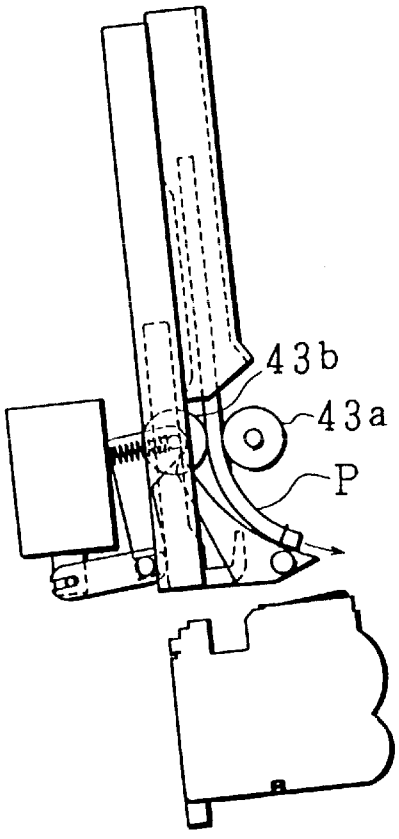
FIG. 19(*a*) is an explanatory view illustrating a state of the stapling operation by the stapling system shown in FIG. 15, in which the stack of paper is brought down to the switching gate after the switching gate is turned so that the stack of paper is discharged on the offset tray.
Figure 19B:
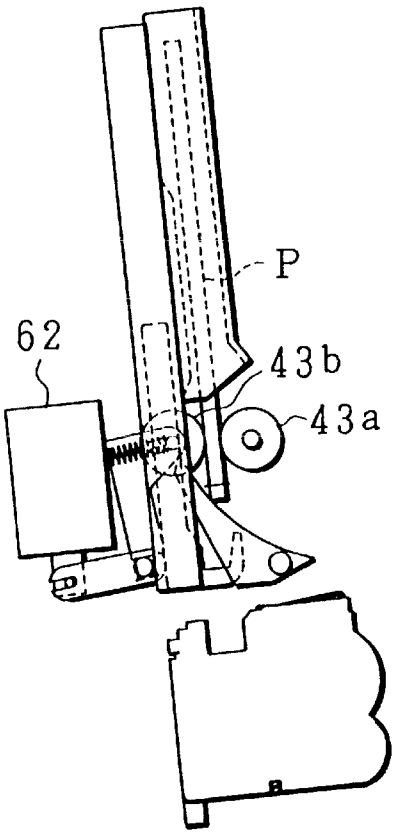
Figure 19A:
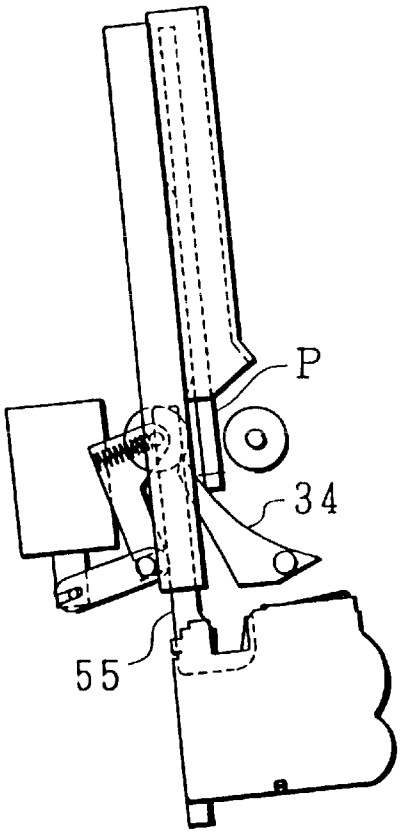

Thereafter, as shown in FIG. 18(*c*) , the switching gate 34 is turned to such a position that the sheets of paper are sent to the offset tray discharge path 27. Then, in this state, the sheet supporter 55 descends and the stack of paper P stops on the switching gate 34, as shown in FIG. 19(*a*). The position of the stack of paper P stopping on the switching gate 34 is the discharge position of the stack of paper P. When the sheet supporter 55 descends, the end portion of the switching gate 34 passes through slits 55*c* (see FIG. 16) provided on the sheet supporter 55. By so doing, the stack of paper P is surely stopped on the switching gate 34.

Thereafter, as shown in FIG. 19(*b*), the solenoid 62 is turned on and causes the driving rollers 43*a* to press the driven rollers 43*b*, whereby the stack of paper P is caught between the rollers 43*a* and 43*b*.

Then, as shown in FIG. 19(*c*), the rollers 43*a* and 43*b* rotate while pressing the stack of paper P, whereby the stack of paper P is transported to the offset tray discharge path 27. Thereafter, by the discharge rollers 44, the stack of paper P is discharged through the offset tray discharge path 27 to the offset tray 11.

As described above, in the sheet post-processing device 1, when sheets of paper are stacked on the lower staple tray 15, the sheets of paper are carried by the sheet supporter 55. Then, in the state in which the sheet supporter 55 carries the sheets stacked, the sheet supporter 55 slides upward/downward along the lower staple tray 15.

Specifically, in the sheet post-processing device 1, when the stack of paper P is formed by stacking a predetermined number of sheets on the sheet supporter 55, the sheet supporter 55 moves the stack of paper P to the stapling position. Then, after application of the stapling operation to the stack of paper P, the stack of paper P is brought up to the recessional position. After the switching gate 34 is turned to such a side (sheet discharge side) that the stack of paper P is allowed to go to the offset tray discharge path 27, the sheet supporter 55 descends again, and in so doing, the stack of paper P is released from the sheet supporter 55 and discharged onto the offset tray 11.

Thus, in the sheet post-processing device 1, by moving not the stapler 59 but the stack of paper P, the stapling and discharge operation is performed with respect to the stack of paper P. Therefore, as to the sheet post-processing device 1, there is no need to provide a driving system for moving the stapler 59. In other words, that the sheet post-processing device 1 becomes complicated and bulky is avoided.

Furthermore, in the sheet post-processing device 1, the stack of paper P stapled is discharged, with the edge stapled going in front. Therefore, without causing the edge of the stack of paper P to fan out, stable discharge can be conducted.

Furthermore, in the sheet post-processing device 1, the offset tray discharge path 27 is substantially horizontally provided, starting from the lower edge of the lower staple tray 15. Therefore, there is no need to bring up the stack of paper P upon discharge of the stack of paper P, and as a result, the driving system including transport rollers can be simplified, thereby facilitating discharge of the sheets of paper.

Furthermore, in the sheet post-processing device 1, the sheet supporter 55 is arranged to move the stack of paper P to the stacking position, the stapling position, and the recessional position. At the stacking position, the lower edge of the sheet supporter 55 is positioned at substantially the same height as that of the lower edge of the lower staple tray 15. The position of the lower edge of the sheet supporter 55 is lower than the position thereof in the case where the stack of paper P is at the recessional position.

Thus, in the sheet post-processing device 1, since the stacking position is lower than the recessional position, the size of paper stackable in the lower staple tray 15 alone can be greater. Note that the height of the stacking position is not limited to this, and it may be equal to either that of the stapling position or that of the recessional position.

Furthermore, in the sheet post-processing device 1, upon discharge of the sheets of paper from the lower staple tray 15, the sheet supporter 55 descends, in a state in which the switching gate 34 is turned to the sheet discharge side. For the foregoing descendence, the slits 55*c* for let the end portion of the switching gate 34 through the sheet supporter 55 are provided in the sheet supporter 55. With this arrangement, the sheets of paper carried on the sheet supporter 55 are surely stopped on the switching gate 34.

Incidentally, the sheet post-processing device 1 is expected to be adapted to an image forming device, placed side by side. Therefore, to reduce the space of a floor that the sheet post-processing device occupies, the staple tray 10 is substantially perpendicularly provided. However, the manner of provision of the staple tray 10 is not limited to this, and the staple tray 10 may be horizontally provided. This arrangement is preferable particularly in the case where sheet post-processing device 1 is placed on the top of or under the image forming device.

Furthermore, in the case where the staple tray 10 is horizontally provided, in adjusting sheets of paper, to utilize the own weight of the sheets is difficult, and therefore, it is preferable to adjust the four edges of the sheets on the staple tray 10.

Furthermore, in the sheet post-processing device 1, all the operation of moving the stack of paper P along the staple tray 10 is carried out by the sheet supporter 55. However, the operation of moving the stack of paper P is not limited to this, and members for moving the stack of paper P may be provided depending on types of the moving operations, respectively.

For example, individual members may be provided (1) for descending the stack of paper P to the staple opening of the stapler 59 from the position at which the stack of paper P is formed, and (2) for moving the stack of paper P away from the staple opening to the recessional position. This arrangement is preferable particularly in the case where the staple tray 10 is horizontally disposed.

Furthermore, in the sheet post-processing device 1, at least either the sheet supporter 55 or the adjusting plates 57 preferably has conductivity and is grounded. By this arrangement, it is possible to remove charge from the sheets of paper stacked on the staple tray 10, whereby adjustment of the sheets of paper on the staple tray 10 is facilitated.

[Third Embodiment]

The following description will explain a third embodiment of the present invention. The members having the same structure (function) as those in the first and second embodiments will be designated by the same reference numerals and their description will be omitted.

The description of the present embodiment will explain a paper guide 70 in detail, which is included in the sheet post-processing device 1 shown in FIG. 1.

As shown in the first embodiment, in the sheet post-processing device 1, in the case where a stapling operation is applied to sheets of paper fed out of the copying machine 2, the sheets of paper are stacked on the staple tray 10, transported through two major transport paths. Then, after the stapling operation, the sheets of paper are fed out to the offset tray 11.

One of the transport paths is a path used to transport small-size paper. In the case where sheets of paper fed out of the copying machine 2 are small, the sheets of paper pass the gap G (see FIG. 1) between the upper staple tray 14 and the lower staple tray 15, and are stacked on the lower staple tray 15. Then, after a post-processing operation is applied thereto, the sheets are discharged onto the offset tray 11 through the lower edge of the staple tray 10.

On the other hand, another transport path is a path used to transport large-size paper. In the case where sheets of paper fed out of the copying machine 2 are large, the sheets do not pass the gap G but are transported through the detour path 22 shown in FIG. 2, and are stacked on the staple tray 10. Then, after a post-processing operation is applied thereto, the sheets are discharged onto the offset tray 11 through the lower edge of the staple tray 10.

The detour path 22 rises from the feed-in opening 4 along the upper staple tray 14 and curving around the upper edge of the upper staple tray 14. Thus, going around inside the main body of the sheet post-processing device 1, the path reaches the lower edge of the lower staple tray 15.

In other words, in the sheet post-processing device 1, the sheet transport paths are provided in an oval shape in peripheral parts of the sheet post-processing device 1.

Furthermore, in the sheet post-processing device 1, a paper guide 70 is provided on an inward side with respect to the detour path 22, vis-a-vis the staple tray 10 which is perpendicularly disposed. The paper guide 70 is provided for preventing the sheets of paper stacked on the staple tray 10 from falling down.

Incidentally, in the case where the paper guide 70 is formed with, for example, one plate, the paper guide 70 cannot be moved. Therefore, in this case, if jamming of paper occurs to the transport paths, inward sides of the oval-loop-like transport paths in the sheet post-processing device 1 cannot be sufficiently exposed.

The sheet post-processing device 1 has the paper guide 70 which has a paper jam solving structure arranged as described below, whereby the inside of the transport paths is fully exposed if a trouble occurs to the transport paths.

The following description will explain an arrangement of the paper guide 70 of the sheet post-processing device 1.

Figure 20:
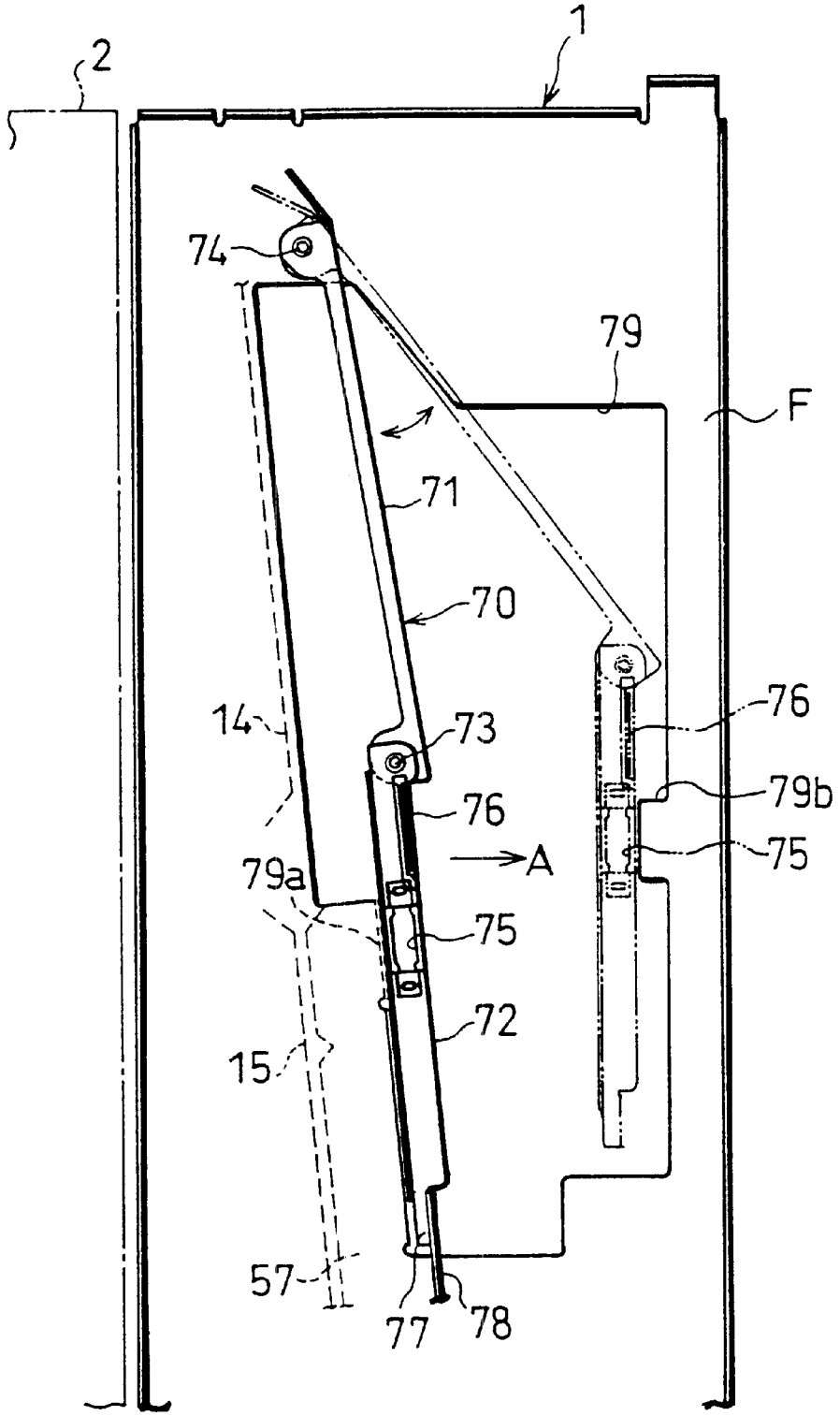
FIG. 20 is a side view illustrating an arrangement of a paper guide as a paper jam solving system of the sheet post-processing device shown in FIG. 1.
Figure 21:
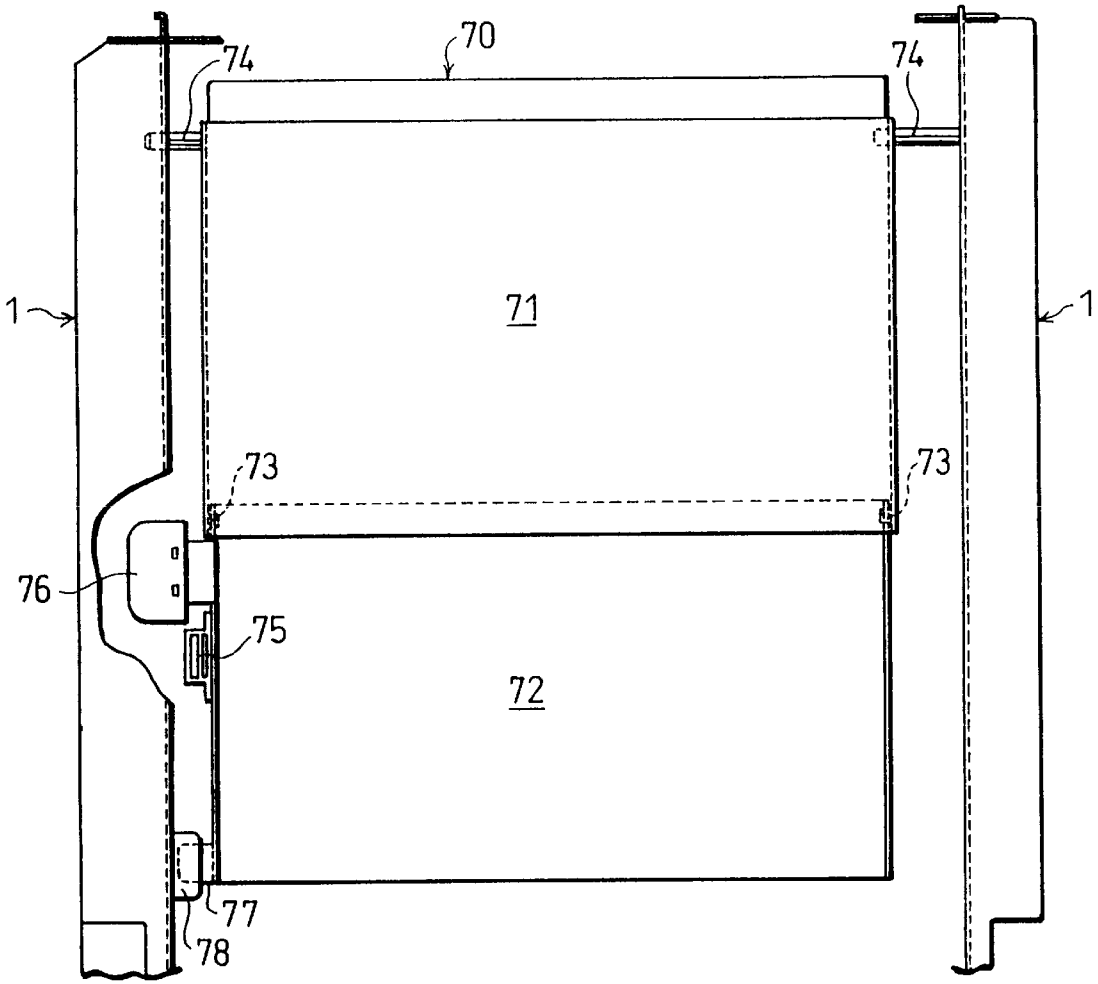
FIG. 21 is a front view illustrating an arrangement of the paper guide shown in FIG. 20.
Figure 22:
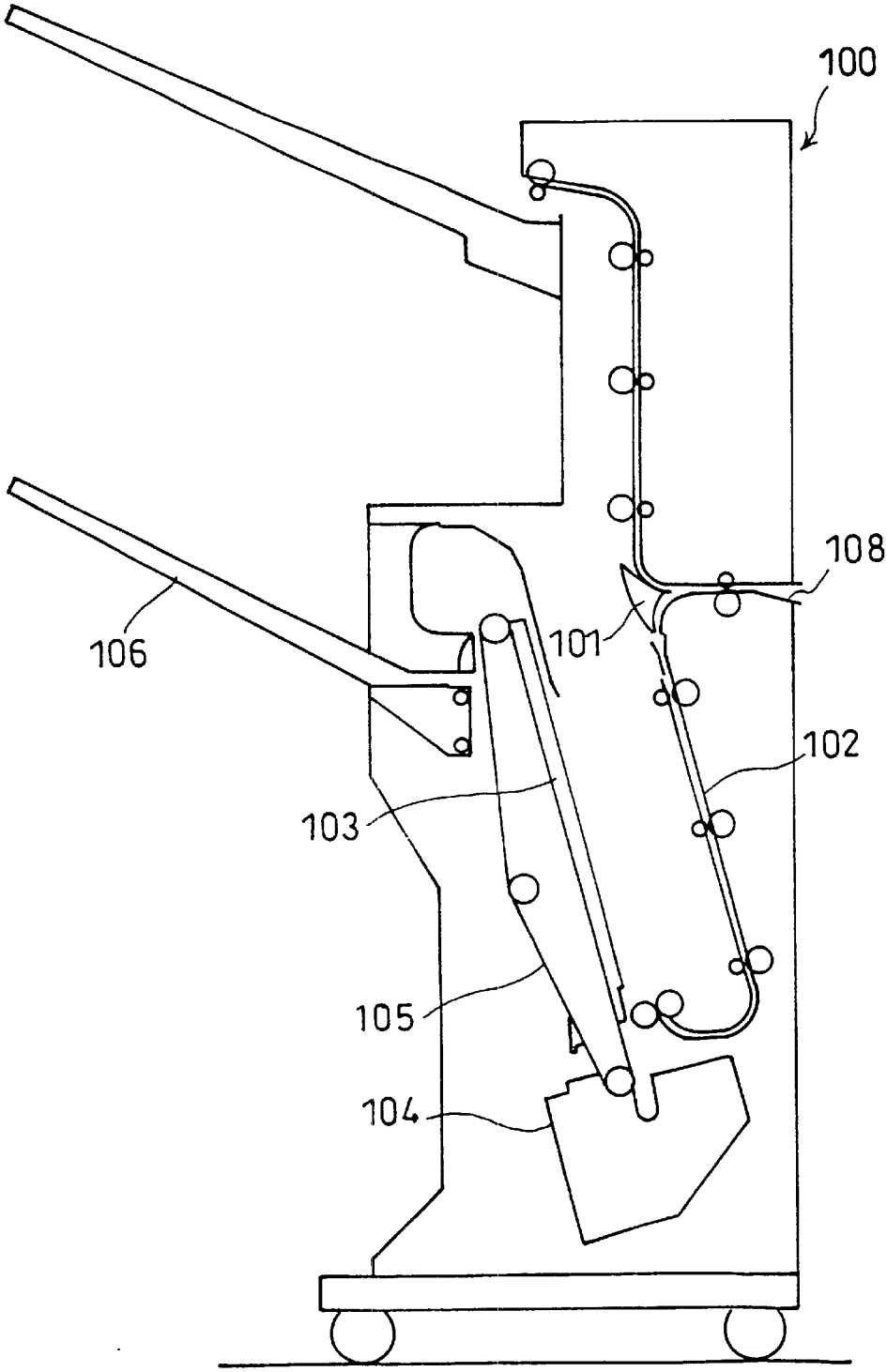
FIG. 22 is an explanatory view illustrating an arrangement of a conventional sheet post-processing device.
Figure 23:
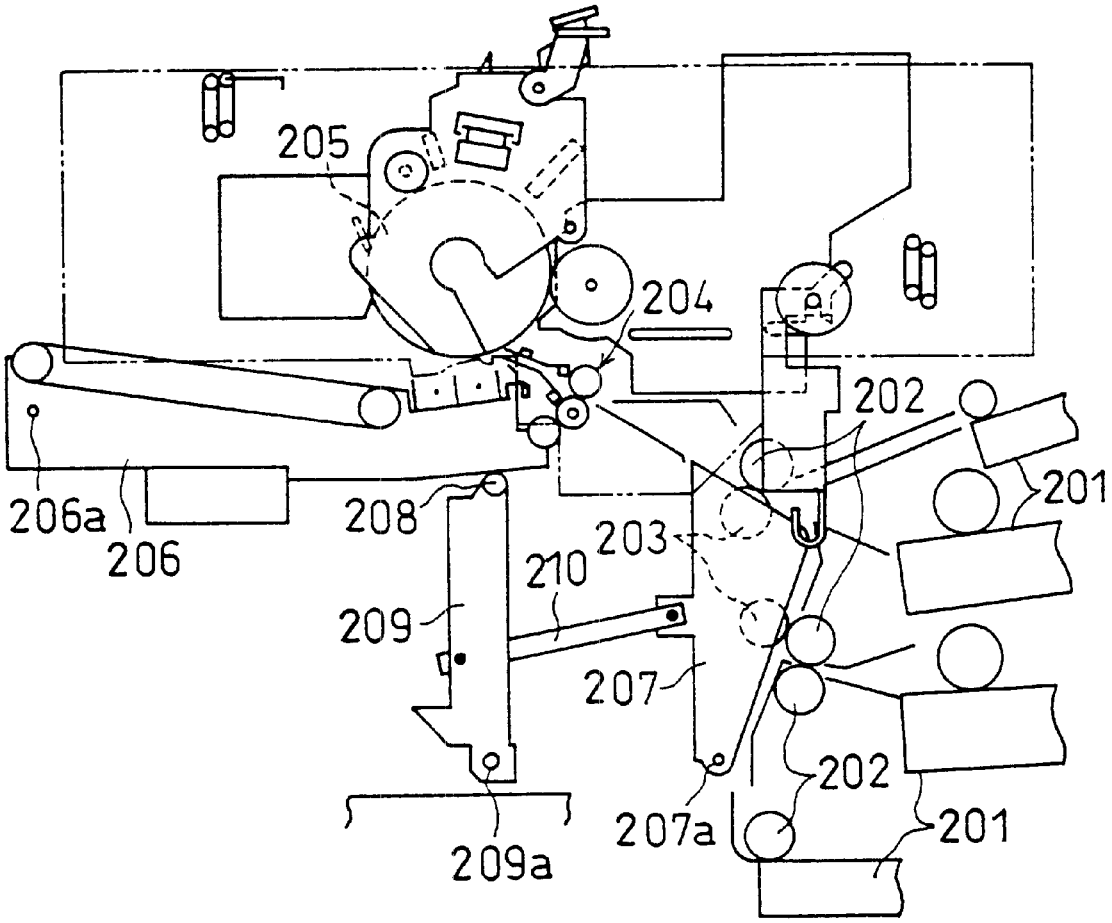
FIG. 23 is an explanatory view illustrating a transport path of a conventional copying machine.
Figure 24:
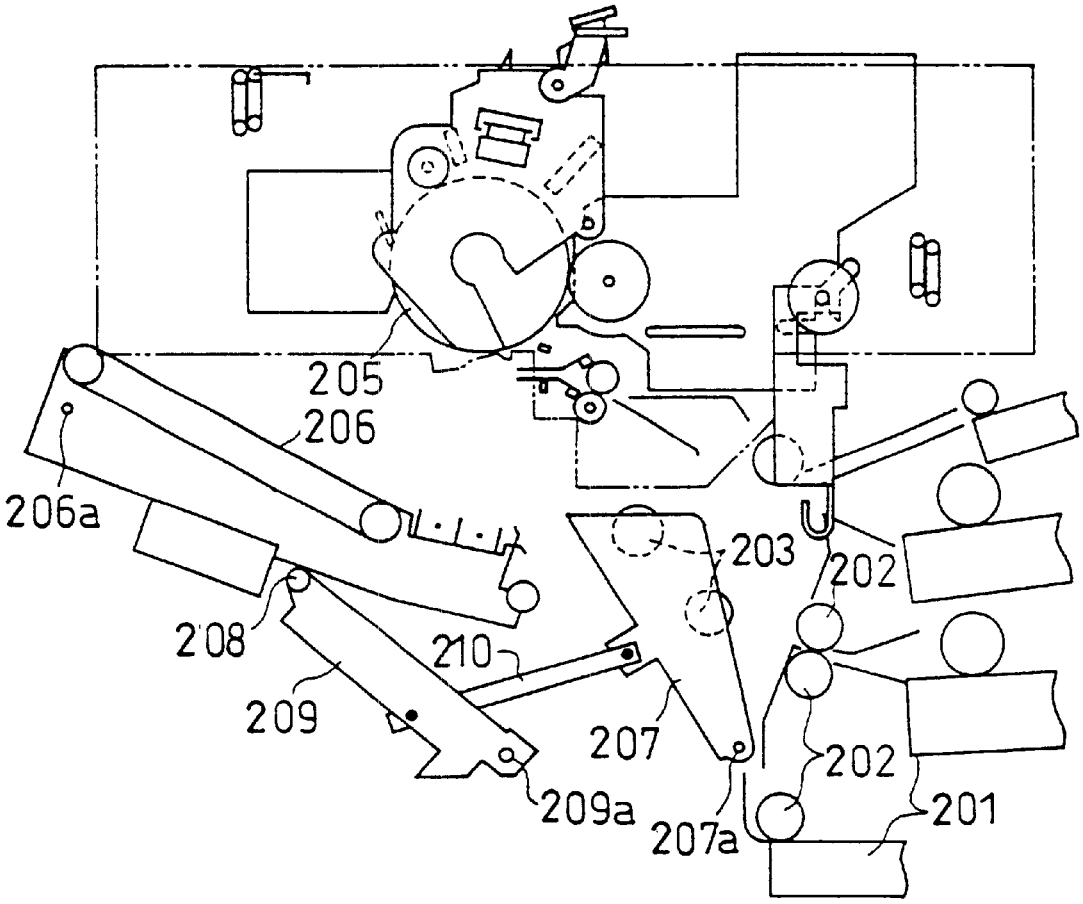
FIG. 24 is an explanatory view illustrating a state in which the transport path of a sheet post-processing device of the copying machine is opened.

FIG. 20 is a side view showing an arrangement of the paper guide 70, and FIG. 21 is a front view showing the same. As shown in these figures, the paper guide 70 is composed of an upper plate 71 and a lower plate 72. The plates 71 and 72 are joined by junction parts 73 provided on both sides in a manner such that the plates 71 and 72 are pivotable.

On upper corners of the upper plate 71, fitting shafts 74 are provided, projecting therefrom. The fitting shafts 74 are fit into a main body frame F of the fixing device 1, in a manner such that upper plate 71 is pivotable.

On the other hand, on one side edge of the lower plate 72, a magnet (catching part) 75 is provided, projecting therefrom. The magnet 75 is attracted and caught by (i) a catching member 79*a* for guiding use and (ii) a projecting catching member 79*b* for opening use, of the metal-made main body frame F of the sheet post-processing device 1. A handle 76 is provided on the edge of the lower plate 72, above the magnet 75.

Furthermore, on a lower end of the side edge of the lower plate 72, a contacting plate 77 is provided, projecting therefrom. At a position vis-a-vis the contacting plate 77, on the main body frame F of the sheet post-processing device 1, a contacted plate 78 is provided, projecting therefrom.

Then, the contacting plate 77 of the lower plate 72 can be brought into contact with a contacted plate 78, on the copying machine 2 side, as shown in FIG. 20. In other words, the contacting plate 77 comes into contact with the contacted plate 78, when moving in such a direction as the paper guide 70 is opened.

The paper guide 70 arranged as described above can be positioned at (i) a guiding position and (ii) an opening position for opening the transport paths, indicated by a solid line and a two-dot chain line, respectively, in FIG. 20.

The guiding position is a position (a position visa-vis the staple tray 10) at which the paper guide 70 is placed in order to prevent the sheets of paper stacked on the staple tray 10 from falling down. The opening position is a position at which the paper guide 70 is placed when jamming occurs.

At the opening position, the paper guide 70 is in a shape conformable to the oval-loop-like detour path 22. The paper guide 70 can be placed at the opening position, by pivoting the plates 71 and 72.

The following description will explain the pivoting operations of the paper guide 70.

In the case where sheets stacked on the staple tray 10 composed of the upper and lower staple trays 14 and 1s are jamming, the operator opens a side wall (not shown) of the sheet post-processing device 1. The operator, by so doing, can look into an opening 79 in a state shown in FIG. 20.

Then, the operator grips the handle 76 on the lower plate 72 of the paper guide 70, and pulls it in an arrow A direction of FIG. 20. By so doing, the magnet 75 and the guiding-use catching member 79*a* of the main body frame F of the sheet post-processing device 1 become separated, no longer adhering to each other. The upper plate 71, which is pivotable with the fitting shafts 74 as a pivot, pivots in an anti-clockwise direction. As a result, the lower plate 72 goes up, whereby the contacting plate 77 moves upward, and the contacting plate 77 and the contacted plate 78 become separated, no longer contacting each other.

Subsequently, the operator pulls up the handle 76 of the lower plate 72. The handle 76 is pulled until the magnet 75 adheres to the opening-use projecting catching member 79*b* of the main body frame F, at the right-hand end of the opening 79, in the sheet post-processing device 1. With this adhesion, the lower plate 72 is caught on the main body frame F, whereby the paper guide 70 is placed at the opening position.

At the opening position, the paper guide 70 is in a shape conformable to the oval-loop-like detour path 22 in the sheet post-processing device 1, and all the transport paths of the sheet post-processing device 1 are exposed. This makes it easy for the operator to solve jamming of paper occurring in the transport paths. More specifically, the operator is allowed to insert his/her hand deeply, thereby being able to solve the jamming of paper easily.

Furthermore, after solving the jamming of paper, the operator pulls the handle 76 in a direction opposite to the arrow A direction. By so doing, the magnet 75 and the opening-use catching member 79*b* of the sheet post-processing device 1 are separated, no longer adhering to each other.

Then, the operator, gripping the handle 76, insets the contact plate 77 of the lower plate 72 behind the contacted plate 78. By so doing, the magnet 75 of the lower plate 72 adheres to the guiding-use catching member 79*a*, whereby the paper guide 70 is placed at the guiding position.

As described above, in the sheet post-processing device 1, the paper guide 70 is manually moved from the guiding position to the opening position, so that the paper guide 70 is deformed to a shape conformable to the detour path 22. In other words, by deforming the paper guide 70 to a shape conformable to the detour path 22, the inside thereof is exposed.

Therefore, the oval-shape hollow part surrounded by the detour path 22 is exposed to the operator. This makes it easy for the operator to solve jamming of paper occurring to the detour path 22 or the staple tray 10.

Furthermore, in the sheet post-processing device 1, the paper guide 70 is composed of the two upper and lower plates 71 and 72 which are joined in a manner such that they are pivotable. Therefore, an opened area of a greater size is ensured, as compared with a case where the paper guide 70 is composed of one plate. As a result, a space in which the paper jam solving operation is carried out can be greatly expanded, thereby making it easier for the operator to solve the jamming of paper.

Furthermore, since the paper guide 70 is composed of the two plates 71 and 72, even if the sheet post-processing device 1 is made thinner whereby the detour path 22 is in a depressed oval loop form, it is possible to open the paper guide 70 by deforming it to a shape conformable to the depressed oval loop. Therefore, regarding the sheet post-processing device 1, a sufficiently opened state of the transport paths is ensured, while the device can be made thinner.

Furthermore, in the sheet post-processing device 1, the upper edge of the upper plate 71 of the paper guide 70 is fit to the main body frame F of the sheet post-processing device 1 by utilizing the fitting shafts 74, in a manner such that the upper plate 71 is pivotable. Therefore, in moving the paper guide 70 to the opening position, an area of a greater size is exposed inside the detour path 22 in the oval-loop shape.

Furthermore, the magnet 75 which can be caught by the guiding-use catching member 79*a* and the opening-use projecting catching member 79*b* of the main body frame F of the sheet post-processing device 1 is provided on the lower plate 72. This ensures that the paper guide 70 is properly fixed at the guiding position and the opening position. In other words, in the sheet post-processing device 1, the paper guide 70 is surely kept at the position vis-a-vis the staple tray 10, by using the magnet 75.

Furthermore, In the sheet post-processing device 1, the magnet 75 is used to fixing the paper guide 70 at the guiding position and the opening position. Therefore, in moving the paper guide 70 between the guiding position and the opening position, the paper guide 70 is easily stopped at the guiding position or the opening position only by bringing the paper guide 70 more or less close thereto. Besides, only by pulling it, the paper guide 70 is moved away therefrom. Thus, the paper guide 70 is more easily moved between the guiding position and the opening position.

Furthermore, the sheet post-processing device 1 is arranged so that, in moving the paper guide 70 between the guiding position and the opening position, the operator manipulates by gripping the handle 76 provided on the lower plate 72. For this reason, the manipulability of the paper guide 70 is greatly enhanced.

Furthermore, in the paper guide 70, the handle 76 is provided on the lower plate 72. This means that the paper guide 70 is moved with its end portion gripped, and as a result, the manipulation of the paper guide 70 is more efficiently carried out as compared with the case where the paper guide 70 is moved with its portion close to the pivot being gripped.

Furthermore, on the lower plate 72 of the paper guide 70, the handle 76, the magnet 75, and the contact plate 77 are provided in this order from the top. Therefore, since the operator grips the handle 76 in manipulating the paper guide 70 , t he paper guide 70 is moved by utilizing the leverage, wherein in this case the handle 76, the contact plate 77, and the magnet 75 are the point of force, the fulcrum, and the point of action, respectively. Consequently, without applying a great force, the operator can shift the paper guide 70 easily.

Incidentally, in the present embodiment, the paper guide 70 is composed of the two plates, but the structure of the paper guide 70 is not limited to this. The paper guide 70 may be composed of more than two plates. By this arrangement, it is possible to the paper guide 70 be deformed to a shape more conformable to the detour path 22 when the paper guide 70 is shifted to the opening position.

Furthermore, in the present embodiment the magnet 75 is used for fixing the paper guide 70 to the guiding position and the opening position, but the member for fixing the paper guide 70 is not limited to the magnet 75. Anything can be adapted, for example, concave and convex members interfitting to each other, or hooking members, provided that the lower plate 72 is surely caught on the main body frame F of the sheet post-processing device 1.

Furthermore, the handle 76 of the paper guide 70 is provided above the magnet 75 of the lower plate 72, but the position of the handle 76 of the paper guide 70 is not limited to this. The handle 76 may be provided on, for example, the upper plate 71. Alternatively, the handle 76 may be provided right on the magnet 75 of the lower plate 72 so that the handle 76 overlaps the magnet 75.

Furthermore, though the descriptions of the first through third embodiments mention only the case where the stapling operation is applied as the post-processing operation conducted by the sheet post-processing device 1 with respect to sheets of paper, the post-processing operation conducted by the sheet post-processing device 1 is not limited to the stapling operation. The sheet post-processing device 1 is capable of performing, in addition to the stapling operation, a punching operation, a gluing operation, and the like with respect to sheets of paper.

As has been described so far, a first sheet post-processing device of the present invention is a sheet post-processing device, which stacks on a post-processing tray sheets of paper discharged from an image forming device and discharges the stacked sheets of paper after applying a post-processing operation thereto, is arranged so that (i) a feed-in opening through which the sheets of paper are supplied from the image forming device is positioned between an imaginary horizontal plane crossing an upper edge of the post-processing tray and an imaginary horizontal plane crossing the lower edge of the post-processing tray, and (ii) the post-processing tray is provided so as to have such inclination that a length of the post-processing tray projected on a vertical plane is greater than a length of the post-processing tray projected on a horizontal plane.

With the foregoing arrangement, the post-processing tray and the feed-in opening are provided so that the feed-in opening through which sheets of paper are supplied from the image forming device is positioned between the imaginary horizontal plane crossing the upper edge of the post-processing tray and the imaginary horizontal plane crossing the lower edge of the post-processing tray, or to state differently, a part of the post-processing tray is positioned upper than the feed-in opening. By this arrangement, the post-processing tray is provide in the upper part of the sheet post-processing device. In this case, even if the sheets of paper to which the post-processing operation is applied are discharged from the post-processing tray through the lower edge thereof to the discharge tray without being brought up, a sufficient discharge capacity can be obtained.

Furthermore, a second sheet post-processing device of the present invention is arranged so as to include a detour transport path through which the sheets of paper supplied through the feed-in opening are transported to the post-processing tray by going around the upper edge or the lower edge of the post-processing tray.

With the foregoing arrangement, even in the case where the post-processing tray is substantially perpendicularly provided in the sheet post-processing device, the sheets of paper are supplied to the post-processing tray through the detour transport path which goes around either the upper edge or the lower edge of the post-processing tray and is connected to an edge of the post-processing tray which is an edge other than the edge that the detour transport path goes around. By this arrangement, if the width of the sheet post-processing device in the sheet transport direction is set smaller, the radius of curvature of the curving part of the detour transport path can be set sufficiently great, whereby stable sheet transportation is ensured.

Furthermore, a third sheet post-processing device of the present invention is the second sheet post-processing device further including (i) at least one first discharge tray to which the sheets of paper are supplied through a first discharge transport path which is provided in the upper part of the sheet post-processing device and branches out from the detour transport path on a side opposite to the feed-in opening side, and (ii) a second discharge tray to which the sheets of paper are supplied from the post-processing tray through a second discharge transport path which is provided in the lower part of the sheet post-processing device and extends from the lower edge of the post-processing tray on the side opposite to the feed-in opening side.

According to the foregoing arrangement, the sheet post-processing device has the first and second discharge trays. Here, in the case where the image forming device has a facsimile function, a print function, and the like in addition to the copy function, the first and second discharge trays can be used respectively for the operational modes of the image forming device.

Furthermore, since the first discharge transport path branches out from the detour transport path, there is no need to ensure a space for a transport path for discharging the sheets of paper to the first discharge tray. Therefore, it is possible to provide the first discharge tray at as upper a position as possible in the sheet post-processing device, and with this, it is possible to provide the second discharge tray at an upper position. This enables that the second discharge tray has a sufficiently great capacity, and that the first discharge tray with a relatively small capacity can be provided on the same side as the second discharge tray is.

Furthermore, a fourth sheet post-processing device of the present invention is the second or third sheet post-processing device further including a reversing transport path for reversing and sending the sheets of paper to the detour transport path, and the reversing transport path is provided substantially perpendicularly between the post-processing tray and the feed-in opening, in a manner such that end portions of the reversing transport path and the detour transport path in the vicinity of a junction therebetween are linearly provided.

With to the foregoing arrangement wherein the reversing transport path is substantially perpendicularly between the post-processing tray and the feed-in opening, it is possible to prevent the provision of the reversing transport path from causing the width of the sheet post-processing device to increase. Furthermore, since the reversing transport path is provided so that the end portions of the reversing transport path and the detour transport path in the vicinity of a junction therebetween are linearly provided, transport jamming of sheets of paper during the reversing operation scarcely occurs.

Furthermore, a fifth sheet post-processing device of the present invention is any one of the second through fourth sheet post-processing devices further including a direct transport path for transporting the sheets of paper supplied through the feed-in opening directly to the center of the post-processing tray so that the detour transport path is not used, wherein in the center of the post-processing tray, there is provided a sheet passing opening through which the sheets of paper transported through the direct transport path are sent to a surface of the post-processing tray.

With the foregoing arrangement, the sheets of paper supplied through the feed-in opening are transported to the surface of the post-processing tray, without using the detour transport path, but by using the direct transport path which directly sends the sheets of paper thereto through the sheet passing opening to the center of the post-processing tray. Consequently, for example, sheets of paper to which no post-processing operation is applied are discharged to the second discharge tray through a short transport route, without using the detour transport path. Therefore, a time since the commencement of the copying operation until the first sheet is discharged, that is, a first copy time, is shortened, and besides, occurrence of transport jamming of paper can be suppressed since sheets of paper are transported not via the curving detour transport path.

Furthermore, a sixth sheet post-processing device of the present invention is either the fourth or fifth sheet post-processing device further arranged so that (i) the entrance/exit of the reversing transport path and the sheet passing opening are provided next to each other, (ii) three associated rollers for transporting the sheets of paper to the entrance/exit of the reversing transport path and the sheet passing opening, the three associated rollers being provided in the vicinity of the entrance/exit of the reversing transport path and the sheet passing opening, and (iii) the transport rollers other than the three associated rollers are driven by a first driving system, while the three associated rollers are driven by a second driving system.

According to the foregoing arrangement, the entrance/exit of the reversing transport path and the sheet passing opening are provided next to each other and a pair of transport rollers rotatable in non-reverse and reverse directions both and a pair of transport rollers for the sending the sheets of paper to the sheet passing opening of the post-processing tray are all together composed of the three associated rollers. Therefore, the reversing transport path and the entrance/exit of the post-processing tray are provided close to each other, whereby increase of the width of the sheet post-processing device can be prevented.

Furthermore, only the three associated rollers are driven by the second driving system, while the other transport rollers are driven by the first driving system, whereby the transport roller driving system structure can be simplified.

Furthermore, a seventh sheet post-processing device of the present invention is either the fourth or fifth sheet post-processing device further arranged so that a part of the post-processing tray and the reversing transport path are pivotably provided, and by pivoting the part of the post-processing tray and the reversing transport path, the sheets of paper sent thereto through the direct transport path are guided to either the post-processing tray or the reversing transport path.

With the foregoing arrangement, in the case where the sheets of paper sent thereto through the direct transport path are to be guided to the post-processing tray, the post-processing tray is pivoted, whereby a space on the sheet holding surface side of the post-processing tray becomes larger. As a result, a stacking capacity of the post-processing tray can be expanded.

Furthermore, an eighth sheet post-processing device of the present invention, which stacks on a post-processing tray sheets of paper discharged from an image forming device and discharges the stacked sheets of paper after a post-processing operation is applied thereto by post-processing means, is arranged so as to comprise (i) adjusting-moving means which is movably provided on the post-processing tray so as to slide along the post-processing tray, the adjusting-moving means moving the sheets of paper stacked on the post-processing tray so as to be adjusted at a post-processing position at which a post-processing operation can be performed by the post-processing means, and thereafter moving the sheets of paper subjected to the post-processing operation by the post-processing means away from the post-processing position with an edge of the stack of sheets of paper subjected to the post-processing operation being put in the rear, and (ii) discharging means for discharging from the post-processing tray the stack of paper moved away from the post-processing position after the post-processing operation, with the edge of the stack of paper subjected to the post-processing operation being put in front.

According to the foregoing arrangement, when the sheets of paper are stacked on the post-processing tray, the sheets of paper stacked are moved by the adjusting-moving means to the post-processing position at which the post-processing operation by the post-processing means is applicable. Here, the sheets of paper are adjusted at the post-processing position.

The sheets of paper subjected to the post-processing operation at the post-processing position are moved away from the post-processing position by the adjusting-moving means, with the edge subjected to the post-processing operation being put in the rear, and the discharging means discharges from the post-processing tray the sheets of paper thus moved away from the post-processing position, with the edge subjected to the post-processing operation being put in front.

With the foregoing arrangement wherein the post-processing and discharging operations are thus performed by moving the stack of sheets of paper without moving the post-processing means such as a stapler, a driving system for moving the post-processing means is unnecessary, whereby the sheet post-processing device can be prevented from becoming complicated and bulky.

Furthermore, since the stack of paper is discharged with the edge thereof stapled being put in front in the case where the stapling operation is carried out as the post-processing operation, the edge of the stack of paper by no means fans out when the sheets of paper are discharged, thereby ensuring stable discharge of the sheets of paper.

Furthermore, a ninth sheet post-processing device of the present invention is the eighth sheet post-processing device further arranged so that (1) the post-processing tray is substantially perpendicularly provided in the sheet post-processing device, (2) the post-processing means is provided below the post-processing tray, (3) the adjusting-moving means is movably provided so as to slide along the post-processing tray upward/downward and includes a sheet supporting member for supporting lower edges of the sheets of paper stacked on the post-processing tray and adjusting the lower edges of the sheets, wherein (i) when a predetermined number of sheets of paper are stacked on the sheet supporting member, the sheet supporting member while carrying the sheets of paper moves to the post-processing position at which the post-processing means conducts the post-processing operation with respect to the sheets of paper, (ii) then, after the post-processing operation is applied to the sheets of paper by the post-processing means, the sheet supporting member goes up while supporting the sheets of paper thus subjected to the post-processing operation, (iii) and the discharging means discharges the sheets of paper brought up after the completion of the post-processing operation by the sheet supporting member.

With the foregoing arrangement, in the case where the sheets of paper are stacked on the post-processing tray, the sheets of paper are supported by the sheet supporting member, and the sheet supporting member can slides upward/downward along the post-processing tray, while carrying the sheets of paper thus stacked. Therefore, when a predetermined number of sheets are stacked on the sheet supporting member, the sheet supporting member moves to the post-processing position while carrying the sheets of paper thus stacked, and goes up after the post-processing operation is applied to the sheets of paper. Then, the sheet supporting member stops supporting the sheets of paper, and the sheets of paper are discharged.

Thus, the post-processing and discharging operations are carried out by moving the sheets of paper after the post-processing operation, without moving the post-processing means such as a stapler. Therefore, a driving system for moving the post-processing means is unnecessary, whereby the sheet post-processing device can be prevented from becoming complicated and bulky.

Furthermore, in the case where the stapling operation is performed as the post-processing operation, since the sheets of paper are discharged with the edges of sheets stapled being put in front, the edges of the sheets by no means fan out when the sheets of paper are discharged, thereby ensuring stable discharge of the sheets of paper.

Furthermore, a tenth sheet post-processing device of the present invention is the ninth sheet post-processing device further arranged so that the adjusting-moving means is movably provided so as to slide rightward/leftward along the post-processing tray and includes a sheet adjusting member for adjusting side edges of the sheets of paper stacked on the post-processing tray, wherein at least either the sheet supporting member or the sheet adjusting member is conductive and grounded.

With the foregoing arrangement, if the sheets of paper stacked on the post-processing tray are charged, the charge is removed from the sheets of paper through the sheet supporting member or the sheet adjusting member, whereby the adjusting operation of the sheets of paper on the post-processing tray is facilitated.

Furthermore, an eleventh sheet post-processing device of the present invention is any one of the eighth through tenth sheet post-processing devices further arranged so that the discharge transport path used for discharging the sheets of paper subjected to the post-processing operation is substantially horizontally provided, extending from the lower edge of the post-processing tray.

With the foregoing arrangement, the sheets of paper subjected to the post-processing operation are discharged through the discharge transport path extending substantially horizontally from the lower edge of the post-processing tray. Therefore, there is no need to bring the sheets of paper upward, and this simplifies the driving system such as the transport rollers, thereby making the sheet discharging operation easier.

Furthermore, a first paper jam solving system of a sheet post-processing device of the present invention is a paper jam solving system of the sheet post-processing device in which sheets of paper supplied from an image forming device are stacked on a post-processing tray and a stapling operation is applied as a post-processing operation to the sheets of paper thus stacked, and thereafter the sheets of paper are discharged to the discharge tray, and is characterized in that (1) the post-processing tray is perpendicularly provided and (2) an opening through which the sheets of paper supplied from the image forming device are passed is provided at a substantially middle position of the post-processing tray, wherein (i) the sheets of paper supplied from the image forming device are supplied through the opening to a lower part of the post-processing tray and are stacked thereon, and thereafter are discharged to the discharge tray through a lower edge of the post-processing tray, or (ii) the sheets of paper are transported along an upper part of the post-processing tray and sent to the lower part of the post-processing tray through a detour transport path which goes around an upper edge of the upper part of the post-processing tray, goes through peripheral parts of the sheet post-processing device main body, and reaches the lower edge of the lower part of the post-processing tray, and the sheets of paper thus stacked on the post-processing tray are thereafter discharged onto the discharge tray. The paper jam solving system further includes a paper guide for preventing the sheets of paper stacked on the post-processing tray from falling down, which is provided visa-vis the post-processing tray on an inward side to the detour transport path and is composed of a plurality of plates pivotably joined with each other.

With the foregoing arrangement, the sheets of paper supplied from the image forming device are sent through either of the two major transport paths and are stacked on the post-processing tray, and after a stapling operation as the post-processing operation is carried out, the sheets of paper are discharged onto the discharge tray.

One of the transport paths is to be used for paper of a small size. Sheets of such paper supplied from the image forming device are sent through the opening and stacked on the lower part of the post-processing tray perpendicularly provided, and after the post-processing operation, the sheets of paper are discharged onto the discharge tray through the lower edge of the post-processing tray.

On the other hand, the other transport path is to be used for paper of a large size. Sheets of such paper supplied from the image forming device are, not passing the opening, transported directly along the upper part of the post-processing tray which is perpendicularly provided. Then, the sheets of paper are transported through the detour transport path which goes around the upper edge of the upper part of the post-processing tray, goes through the peripheral parts of the main body of the sheet post-processing device, and then, reaches the lower edge of the lower part of the post-processing tray. Thus, the sheets of paper are stacked on the post-processing tray, and after the post-processing operation is applied to the sheets of paper there, the sheets of paper are discharged onto the discharge tray through the lower edge of the post-processing tray.

In other words, in the aforementioned arrangement, the transport path is formed in oval, going through the peripheral parts of the sheet post-processing device.

On the other hand, the paper guide for preventing the sheets of paper stacked from falling down is provided on an inward side to the transport path, vis-a-vis the post-processing tray which is perpendicularly provided.

Here, when jamming of paper occurs to the post-processing tray, the paper guide can be opened since there is an oval hollow space on the inward side to the detour transport path. However, if the paper guide is composed of one plate, the paper guide cannot be deformed so as to conform with the oval, and therefore, sufficient disclosure cannot be expected.

However, in the aforementioned arrangement, the paper guide is composed of a plurality of plates pivotably joined with each other. Therefore, it is possible to open the paper guide by deforming it so as to conform with the periphery of the oval space inside the detour transport path, and hence, a sufficient opened space is ensured, whereby the paper jam solving operation is facilitated.

Furthermore, even if thinning the sheet post-processing device causes the oval of the detour transport path to become depressed, the paper guide can be opened, by deforming it so as to conform the depressed oval.

As a result, it is possible to ensure the sufficient opening state of the transport path and to provide the paper jam solving system which allows the sheet post-processing device to be made thinner.

Furthermore, a second paper jam solving system of a sheet post-processing device is the first paper jam solving system of the sheet post-processing device further arranged so that the paper guide is composed of upper and lower plates pivotably joined to each other, wherein an upper edge of the upper plate is pivotably fit to the main body of the sheet post-processing device, while a catching part for causing the lower plate to be caught to the main body of the sheet post-processing device is provided on the lower plate.

With the foregoing arrangement, the paper guide is composed of the two plates, that is, the upper and lower plated, which are pivotably joined with each other. The upper edge of the upper plate is pivotably fit to the main body of the sheet post-processing device. Therefore, in opening the paper guide, the opened space can be made as large as possible inside the oval detour transport path.

Furthermore, the lower plate is equipped with the catching part for causing the lower plate to be caught on the main body of the sheet post-processing device. Therefore, it is possible to ensure that the paper guide is caught at a position vis-a-vis the post-processing tray.

Furthermore, a third paper jam solving system of the present invention is the second paper jam solving system further arranged so that the catching part is made of a magnet.

With the foregoing arrangement wherein the catching part is made of a magnet, in shifting the paper guide from the opening position to the position vis-a-vis the post-processing tray, the paper guide is easily caused to adhere at the position vis-a-vis the post-processing tray, only by closing the paper guide thereto to some extent.

Therefore, the paper guide is easily and surely caught to the main body of the sheet post-processing device. In shifting the paper guide to the opening position, the paper guide is separated therefrom only by pulling it. Thus, the paper guide can be easily shifted to the opening position.

Furthermore, a fourth paper jam solving system of a sheet post-processing device of the present invention is either the second or third paper jam solving system further arranged so that the lower plate of the paper guide is equipped with a handle.

With the foregoing arrangement, the operator can manipulate the paper guide by gripping the handle provided on the lower plate, in shifting the paper guide to the opening position. Therefore, the manipulability in opening the paper guide is enhanced.

Besides, the handle is provided on the lower plate. This means that the paper guide is moved with its end portion gripped, and as a result, the manipulation of the paper guide is more efficiently carried out as compared with the case where the paper guide is moved with its portion close to the pivot being gripped.

Furthermore, a fifth paper jam solving system of a sheet post-processing device of the present invention is the fourth paper jam solving system further arranged so that the handle provided on the lower plate of the paper guide is just above the catching part, while a lower edge of the lower plate of the paper guide is brought into contact with a rear surface of a contacted plate provided on the main body of the sheet post-processing device.

According to the foregoing arrangement, the handle, the catching part, and a contacting part are provided on the lower plate of the paper guide in this order from the top.

Therefore, since the operator grips the handle in manipulating the paper guide in shifting the paper guide to the opening position, the paper guide is moved by utilizing the leverage, wherein in this case the handle, the contacting part, and the catching part are the point of force, the fulcrum, and the point of action, respectively.

As a result, without applying a great force, the operator can shift the paper guide easily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet post-processing device, comprising:

a post-processing tray on which sheets of paper supplied from an image forming device are stacked;

a post-processing section for applying a post-processing operation to edges of one side of the sheets of paper stacked on said post-processing tray;

a first feed-out opening for discharging, to outside, the sheets of paper having been subject to the post-processing operation;

a first discharge transport path for transporting the sheets of paper from said post-processing tray to said first feed-out opening; and a feed-out section for discharging the post-processed sheets of paper from said post-processing tray to said first discharge transport path, wherein said post-processing tray has an adjusting-moving section for adjusting said stacked sheet of paper, moving the adjusted sheets of paper to a post-processing position at which a post-processing operation by said post-processing section can be applied, and moving said post-processed sheets of paper to a discharge position at which a discharging operation by said feed-out section is applied, said adjusting-moving section includes a sheet supporting member which adjusts lower edges of the sheets of paper stacked on said post-processing tray, and slides on said post-processing tray while carrying the sheets of paper thereon so that the sheets of paper are moved to the post-processing position and the discharge position, and said feed-out section has a switching gate for guiding the sheets of paper to either the post-processing position or the discharge position when said sheet supporting member is positioned in the post-processing position or the discharge position.

2. The sheet post-processing device as set forth in claim 1, wherein said feed-out section discharges the sheets of paper from the discharge position, with edges of the sheets of paper to which the post-processing operation is applied by said post-processing section going in front.

3. The sheet post-processing device as set forth in claim 1, wherein:

said post-processing tray is substantially perpendicularly provided, and said post-processing section and said first discharge transport path are provided below said post-processing tray; and said sheet supporting member remains at a predetermined stacking position until a predetermined number of sheets of paper are stacked thereon, subsequently brings the sheets of paper down to the post-processing position, and brings the sheets of paper up to a predetermined recessional position after the post-processing operation is applied to the sheets of paper by said post-processing section at the post-processing position, and thereafter brings the sheets of paper down to the discharge position.

4. The sheet post-processing device as set forth in claim 1, wherein said feed-out section has discharge rollers for supplying a transport force in a downward direction to the sheets of paper when the sheets of paper are placed at the discharge position, so that the sheets of paper are sent to said first discharge transport path.

5. The sheet post-processing device as set forth in claim 1, wherein said adjusting-moving section includes a sheet adjusting member for adjusting side edges of the sheets of paper by sliding on said post-processing tray in a direction perpendicular to the side edges of the sheets of paper stacked on said post-processing tray.

6. The sheet post-processing device as set forth in claim 5, wherein said sheet adjusting member has a sheet guide part for preventing the sheets of paper stacked on said post-processing tray from falling down.

7. The sheet post-processing device as set forth in claim 5, wherein said adjusting-moving section has a paddler for supplying a downward force to the sheets of paper stacked on said post-processing tray so as to assist said sheet supporting member in adjusting the lower edges of the sheets of paper.

8. The sheet post-processing device as set forth in claim 5, wherein at least either said sheet supporting member or said sheet adjusting member has conductivity and is grounded.

9. The sheet post-processing device as set forth in claim 2, wherein said first discharge transport path is substantially horizontally provided from a lower edge of said post-processing tray to said first feed-out opening.

10. The sheet post-processing device as set forth in claim 2, wherein said post-processing section applies a stapling operation to the sheets of paper.

* * * * *